US010490197B2

(12) United States Patent
Kim et al.

(10) Patent No.: US 10,490,197 B2
(45) Date of Patent: Nov. 26, 2019

(54) METHOD AND DEVICE FOR PROCESSING INTERNAL CHANNELS FOR LOW COMPLEXITY FORMAT CONVERSION

(71) Applicant: SAMSUNG ELECTRONICS CO., LTD., Suwon-si (KR)

(72) Inventors: Sun-min Kim, Yongin-si (KR); Sang-bae Chon, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/577,639

(22) PCT Filed: Jun. 17, 2016

(86) PCT No.: PCT/KR2016/006495
§ 371 (c)(1),
(2) Date: Nov. 28, 2017

(87) PCT Pub. No.: WO2016/204581
PCT Pub. Date: Dec. 22, 2016

(65) Prior Publication Data

US 2018/0166082 A1 Jun. 14, 2018

Related U.S. Application Data

(60) Provisional application No. 62/245,191, filed on Oct. 22, 2015, provisional application No. 62/241,082,
(Continued)

(51) Int. Cl.
*H04S 3/00* (2006.01)
*G10L 19/00* (2013.01)
(Continued)

(52) U.S. Cl.
CPC ..... *G10L 19/008* (2013.01); *G10L 19/00* (2013.01); *G10L 19/002* (2013.01); *G10L 19/16* (2013.01);
(Continued)

(58) Field of Classification Search
CPC ..... G10L 19/008; G10L 19/16; G10L 19/002; G10L 19/00; H04S 2400/03; H04S 2400/05; H04S 3/00
See application file for complete search history.

(56) References Cited

U.S. PATENT DOCUMENTS 7,548,853 B2 6/2009 Shmunk et al.
9,311,919 B2 4/2016 Beack et al.
(Continued)

FOREIGN PATENT DOCUMENTS

KR 10-0917843 B1 9/2009
KR 10-1325339 B1 11/2013
(Continued)

OTHER PUBLICATIONS

Neuendorf et al., The ISO/MPEG Unified Speech and Audio Coding Standard—Consistent High Quality for all Content Tyes and All Bit Rates, J. Audio Eng.Soc, vol. 61,No. 12, Dec. 2013.*
(Continued)

*Primary Examiner* — Sonia L Gay
(74) *Attorney, Agent, or Firm* — Sughrue Mion, PLLC

(57) ABSTRACT

A method of processing an audio signal includes receiving an audio bitstream encoded via MPEG Surround 212 (MPS212); generating an internal channel (IC) signal for a single channel pair element (CPE), based on the received audio bitstream, equalization (EQ) values for MPS212 output channels defined in a format converter, and gain values for the MPS212 output channels; and generating stereo output channels, based on the generated IC signal.

15 Claims, 18 Drawing Sheets

Related U.S. Application Data filed on Oct. 13, 2015, provisional application No. 62/241,098, filed on Oct. 13, 2015, provisional application No. 62/181,096, filed on Jun. 17, 2015.

(51) Int. Cl.
*G10L 19/008* (2013.01)
*G10L 19/002* (2013.01)
*G10L 19/16* (2013.01)

(52) U.S. Cl.
CPC ..... *H04S 3/00* (2013.01); *H04S 2400/03* (2013.01); *H04S 2400/05* (2013.01)

(56) References Cited

U.S. PATENT DOCUMENTS

2009/0190766 A1 7/2009 Klayman et al.
2009/0274308 A1* 11/2009 Oh ..... G10L 19/008 381/2
2014/0016785 A1* 1/2014 Neuendorf ..... G10L 19/008 381/22
2014/0023196 A1 1/2014 Xiang et al.
2016/0012825 A1* 1/2016 Kjoerling ..... G10L 19/008 381/22
2016/0071522 A1* 3/2016 Beack ..... G10L 19/008 381/22
2016/0157040 A1* 6/2016 Ertel ..... G10L 19/008 381/18
2016/0232901 A1* 8/2016 Ghido ..... G10L 19/008
2016/0247508 A1* 8/2016 Dick ..... G10L 19/0017
2016/0330560 A1 11/2016 Chon et al.
2017/0278521 A1* 9/2017 Beack ..... G10L 19/008

FOREIGN PATENT DOCUMENTS

KR 10-2015-0038156 A 4/2015
WO 2015/058991 A1 4/2015
WO 2015/105393 A1 7/2015

OTHER PUBLICATIONS

Sang Bae Chon et al., "Proposed Internal Channel for Low Complexity Format Conversion", International Organisation for Standardisation Organisation Internationale De Normalisation, ISO/IEC JTC1/SC29/WG11, Coding of Moving Pictures and Audio, ISO/IEC JTC1/SC29/WG11 MPEG2014/ m36447, Jun. 2015, Warsaw, Poland, XP0300064815. (14 pages total).
Communication dated Feb. 5, 2018 by the European Patent Office in counterpart European Patent Application No. 16811994.9.
International Search Report and Written Opinion dated Sep. 23, 2016, issued by the International Searching Authority in counterpart International Application No. PCT/KR2016/006495 (PCT/ISA/210 & PCT/ISA/237).
Sang Bae Chon et al., "Proposed Internal Channel for Low Complexity Format Conversion", ISO/IEC JTC1/SC29/WG11 MPEG2014/ m35858, Jun. 2015,(15 pages total).
Sang Bae Chon et al. "Technical Description on Internal Channel",ISO/IEC JTC1/SC29/WG11 MPEG2014/ m37031, Oct. 2015 (16 pages total).

* cited by examiner

FIG. 11

Table 1

| | 0 | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 |
|---|---|---|---|---|---|---|---|---|---|---|---|---|---|---|---|---|---|---|---|---|---|---|---|---|
| 0 | 1 | 0 | 1 | 1 | 1 | 0 | 1 | 0 | 1 | 1 | 1 | 0 | 1 | 0 | 1 | 1 | 1 | 0 | 1 | 0 | 1 | 1 | 1 | 0 |
| 1 | 0 | 1 | 1 | 1 | 0 | 1 | 0 | 1 | 1 | 1 | 0 | 1 | 0 | 1 | 1 | 1 | 0 | 1 | 0 | 1 | 1 | 1 | 0 | 1 |
| 2 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 |
| 3 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 |
| 4 | 1 | 0 | 1 | 1 | 1 | 0 | 1 | 0 | 1 | 1 | 1 | 0 | 1 | 0 | 1 | 1 | 1 | 0 | 1 | 0 | 1 | 1 | 1 | 0 |
| 5 | 0 | 1 | 1 | 1 | 0 | 1 | 0 | 1 | 1 | 1 | 0 | 1 | 0 | 1 | 1 | 1 | 0 | 1 | 0 | 1 | 1 | 1 | 0 | 1 |
| 6 | 1 | 0 | 1 | 1 | 1 | 0 | 1 | 0 | 1 | 1 | 1 | 0 | 1 | 0 | 1 | 1 | 1 | 0 | 1 | 0 | 1 | 1 | 1 | 0 |
| 7 | 0 | 1 | 1 | 1 | 0 | 1 | 0 | 1 | 1 | 1 | 0 | 1 | 0 | 1 | 1 | 1 | 0 | 1 | 0 | 1 | 1 | 1 | 0 | 1 |
| 8 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 |
| 9 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 |
| 10 | 1 | 0 | 1 | 1 | 1 | 0 | 1 | 0 | 1 | 1 | 1 | 0 | 1 | 0 | 1 | 1 | 1 | 0 | 1 | 0 | 1 | 1 | 1 | 0 |
| 11 | 0 | 1 | 1 | 1 | 0 | 1 | 0 | 1 | 1 | 1 | 0 | 1 | 0 | 1 | 1 | 1 | 0 | 1 | 0 | 1 | 1 | 1 | 0 | 1 |
| 12 | 1 | 0 | 1 | 1 | 1 | 0 | 1 | 0 | 1 | 1 | 1 | 0 | 1 | 0 | 1 | 1 | 1 | 0 | 1 | 0 | 1 | 1 | 1 | 0 |
| 13 | 0 | 1 | 1 | 1 | 0 | 1 | 0 | 1 | 1 | 1 | 0 | 1 | 0 | 1 | 1 | 1 | 0 | 1 | 0 | 1 | 1 | 1 | 0 | 1 |
| 14 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 |
| 15 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 |
| 16 | 1 | 0 | 1 | 1 | 1 | 0 | 1 | 0 | 1 | 1 | 1 | 0 | 1 | 0 | 1 | 1 | 1 | 0 | 1 | 0 | 1 | 1 | 1 | 0 |
| 17 | 0 | 1 | 1 | 1 | 0 | 1 | 0 | 1 | 1 | 1 | 0 | 1 | 0 | 1 | 1 | 1 | 0 | 1 | 0 | 1 | 1 | 1 | 0 | 1 |
| 18 | 1 | 0 | 1 | 1 | 1 | 0 | 1 | 0 | 1 | 1 | 1 | 0 | 1 | 0 | 1 | 1 | 1 | 0 | 1 | 0 | 1 | 1 | 1 | 0 |
| 19 | 0 | 1 | 1 | 1 | 0 | 1 | 0 | 1 | 1 | 1 | 0 | 1 | 0 | 1 | 1 | 1 | 0 | 1 | 0 | 1 | 1 | 1 | 0 | 1 |
| 20 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 |
| 21 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 |
| 22 | 1 | 0 | 1 | 1 | 1 | 0 | 1 | 0 | 1 | 1 | 1 | 0 | 1 | 0 | 1 | 1 | 1 | 0 | 1 | 0 | 1 | 1 | 1 | 0 |
| 23 | 0 | 1 | 1 | 1 | 0 | 1 | 0 | 1 | 1 | 1 | 0 | 1 | 0 | 1 | 1 | 1 | 0 | 1 | 0 | 1 | 1 | 1 | 0 | 1 |

140
170
160
180
150
190

FIG. 12

Table 2

| | A | B | C | D | E | F | G | H | I | J | K | L | M |
|---|---|---|---|---|---|---|---|---|---|---|---|---|---|
| A | **1** | **1** | **1** | **1** | **1** | **1** | **1** | **1** | **1** | **1** | **1** | **1** | **1** |
| B | 1 | **1** | **1** | **1** | **1** | **1** | **1** | **1** | **1** | **1** | **1** | **1** | **1** |
| C | 1 | 1 | **1** | **1** | **1** | **1** | **1** | **1** | **1** | **1** | **1** | **1** | **1** |
| D | 1 | 1 | 1 | **1** | **1** | **1** | **1** | **1** | **1** | **1** | **1** | **1** | **1** |
| E | 1 | 1 | 1 | 1 | **1** | **1** | **1** | **1** | **1** | **1** | **1** | **1** | **1** |
| F | 1 | 1 | 1 | 1 | 1 | **1** | **1** | **1** | **1** | 0 | 0 | 0 | 0 |
| G | 1 | 1 | 1 | 1 | 1 | 1 | **1** | **1** | **1** | 0 | 0 | 0 | 0 |
| H | 1 | 1 | 1 | 1 | 1 | 1 | 1 | **1** | **1** | 0 | 0 | 0 | 0 |
| I | 1 | 1 | 1 | 1 | 1 | 1 | 1 | 1 | **1** | 0 | 0 | 0 | 0 |
| J | 1 | 1 | 1 | 1 | 1 | 0 | 0 | 0 | 0 | **1** | **1** | **1** | **1** |
| K | 1 | 1 | 1 | 1 | 1 | 0 | 0 | 0 | 0 | 1 | **1** | **1** | **1** |
| L | 1 | 1 | 1 | 1 | 1 | 0 | 0 | 0 | 0 | 1 | 1 | **1** | **1** |
| M | 1 | 1 | 1 | 1 | 1 | 0 | 0 | 0 | 0 | 1 | 1 | 1 | **1** |

FIG. 13

Table 5

| LoudspeakerGeometry as defined in ISO /IEC 23001-8) | Channel | Azimuth [deg] | Elevation [deg] | Azimuth start angle of sector [deg] | Azimuth end angle of sector [deg] | Elevation start angle of sector [deg] | Elevation end angle of sector [deg] | Ch. is LFE | Position is relative |
|---|---|---|---|---|---|---|---|---|---|
| 43 | CH_I_CNTR | 0 | 0 | 0 | 0 | 0 | 0 | 0 | 0 |
| 44 | CH_I_LFE | 0 | n/a | n/a | n/a | n/a | n/a | 1 | 0 |
| 45 | CH_I_LEFT | 30 | 0 | 30 | 30 | 0 | 0 | 0 | 0 |
| 46 | CH_I_RIGHT | -30 | 0 | -30 | -30 | 0 | 0 | 0 | 0 |

FIG. 14

Table 8

| Syntax | No. of bits | Mnemonic |
|---|---|---|
| mpegh3daExtElementConfig() | | |
| { | | |
| usacExtElementType = escapedValue(4, 8, 16); | | |
| usacExtElementConfigLength = escapedValue(4, 8, 16); | | |
| **if (usacExtElementDefaultLengthPresent) {** | **1** | **uimsbf** |
| usacExtElementDefaultLength = escapedValue(8, 16, 0) + 1; | | |
| } else { | | |
| usacExtElementDefaultLength = 0; | | |
| } | | |
| **usacExtElementPayloadFrag;** | **1** | **uimsbf** |
| switch (usacExtElementType) { | | |
| case ID_EXT_ELE_FILL: | | |
| /* No configuration element */ | | |
| break; | | |
| case ID_EXT_ELE_MPEGS: | | |
| SpatialSpecificConfig(); | | |
| break; | | |
| case ID_EXT_ELE_SAOC: | | |
| SAOCSpecificConfig(); | | |
| break; | | |
| case ID_EXT_ELE_AUDIOPREROLL: | | |
| /* No configuration element */ | | |
| break; | | |
| case ID_EXT_ELE_UNI_DRC: | | |
| mpegh3daUniDrcConfig(); | | |
| break; | | |
| case ID_EXT_ELE_OBJ_METADATA: | | |
| ObjectMetadataConfig(); | | |
| break; | | |
| case ID_EXT_ELE_SAOC_3D: | | |
| SAOC3DSpecificConfig(); | | |
| break; | | |
| case ID_EXT_ELE_HOA: | | |
| HOAConfig(); | | |
| break; | | |
| case ID_EXT_ELE_FMT_CNVRTR: | | |
| /* No configuration element */ | | |
| break; | | |
| **case ID_EXT_ELE_ICG:** | | |
| **ICGConfig();** | | |
| **break;** | | |
| default: | NOTE | |
| while (usacExtElementConfigLength--) { | | |
| **tmp;** | **8** | **uimsbf** |
| } | | |
| break; | | |
| } | | |
| } | | |

NOTE: The default entry for the usacExtElementType is used for unknown extElementTypes so that legacy decoders can cope with future extensions

FIG. 15

Table 9

| usacExtElementType | Value |
|---|---|
| ID_EXT_ELE_FILL | 0 |
| ID_EXT_ELE_MPEGS | 1 |
| ID_EXT_ELE_SAOC | 2 |
| ID_EXT_ELE_AUDIOPREROLL | 3 |
| ID_EXT_ELE_UNI_DRC | 4 |
| ID_EXT_ELE_OBJ_METADATA | 5 |
| ID_EXT_ELE_SAOC_3D | 6 |
| ID_EXT_ELE_HOA | 7 |
| ID_EXT_ELE_FMT_CNVRTR | 8 |
| ID_EXT_ELE_ICG | 9 |
| /*reserved for ISO use*/ | 10-127 |
| /*reserved for use outside of ISO scope*/ | 128 and higher |
| NOTE : Application-specific usacExtElementType values are mandated to be in the space reserved for use outside of ISO scope. These are skipped by a decoder as a minimum of structure is required by the decoder to skip these extensions. | |

FIG. 16

Table 10

| Value | Meaning |
|---|---|
| 0 | Loudspeaker layout is signaled by means of ChannelConfiguration index as defined in ISO/IEC 23001-8. |
| 1 | Loudspeaker layout is signaled by means of a list of LoudspeakerGeometry indices as defined in ISO/IEC 23001-8 |
| 2 | Loudspeaker layout is signaled by means of a list of explicit geometric position information. |
| 3 | Loudspeaker layout is signaled by means of LCChannelConfiguration index. Note that the LCChannelConfiguration has same layout with ChannelConfiguration but different channel orders to enable the optimal internal channel structure using CPE. |

FIG. 17

Table 11

| Syntax | No. of bits | Mnemonic |
|---|---|---|
| SpeakerConfig3d() | | |
| { | | |
| speakerLayoutType; | 2 | uimsbf |
| if (speakerLayoutType == 0 \|\| speakerLayoutType == 3) { | | |
| CICPspeakerLayoutIdx; | 6 | uimsbf |
| } | | |
| else { | | |
| numSpeakers = escapedValue(5, 8, 16) + 1; | | |
| if (speakerLayoutType == 1 ) { | | |
| for (i = 0; i < numSpeakers; i++) { | | |
| CICPspeakerIdx; | 7 | uimsbf |
| } | | |
| } | | |
| if (speakerLayoutType == 2 ) { | | |
| mpegh3daFlexibleSpeakerConfig(numSpeakers); | | |
| } | | |
| } | | |
| } | | |

FIG. 18

Table 12

| immersiveDownmixFlag | Meaning |
|---|---|
| 0 | Generic format converter shall be applied as defined in clause 10. |
| 1 | If the local loudspeaker setup, signaled by LoudspeakerRendering(), is signaled as<br>(speakerLayoutType==0 or 3,CICPspeakerLayoutIdx==5)<br>or as<br>(speakerLayoutType==0 or 3,CICPspeakerLayoutIdx==6),<br>independently of potentially signaled loudspeaker displacement angles, then immersive rendering format converter shall be applied as defined in clause 11.<br>In all other case the generic format converter shall be applied as defined in clause 10. |

METHOD AND DEVICE FOR PROCESSING INTERNAL CHANNELS FOR LOW COMPLEXITY FORMAT CONVERSION

TECHNICAL FIELD

The present invention relates to internal channel (IC) processing methods and apparatuses for low complexity format conversion, and more particularly, to a method and apparatus for reducing the number of covariance operations performed in a format converter by reducing the number of ICs of the format converter by performing IC processing with respect to input channels in a stereo output layout environment.

BACKGROUND ART

According to MPEG-H 3D Audio, various types of signals can be processed and the type of an input/output can be easily controlled. Thus, MPEG-H 3D Audio may function as a solution for next-generation audio signal processing. In addition, according to trends toward miniaturization of apparatuses, the percentage of audio reproduction via a mobile device in a stereo reproduction environment has increased.

When an immersive audio signal realized via multiple channels, such as 22.2 channels, is delivered to a stereo reproducing system, all input channels should be decoded, and the immersive audio signal should be downmixed to be converted into a stereo format.

As the number of input channels is increased and the number of output channels is decreased, the complexity of a decoder necessary for a covariance analysis and a phase alignment increases during the process described above. This increase in complexity affects not only an operation speed of mobile devices but also battery consumption of mobile devices.

DETAILED DESCRIPTION OF THE INVENTION

TECHNICAL PROBLEM

As described above, the number of input channels is increased to provide an immersive audio, whereas the number of output channels is decreased to achieve portability. In this environment, the complexity of format conversion during decoding becomes problematic.

To address this matter, the present invention provides reduction of the complexity of format conversion in a decoder.

TECHNICAL SOLUTION

Representative features of the present invention to achieve the aforementioned goals are as follows.

According to an aspect of the present invention, there is provided a method of processing an audio signal, the method including: receiving an audio bitstream encoded via MPEG Surround 212 (MPS212); generating an internal channel (IC) signal for a single channel pair element (CPE), based on the received audio bitstream, equalization (EQ) values for MPS212 output channels defined in a format converter, and gain values for the MPS212 output channels; and generating stereo output channels, based on the generated IC signal.

The generating of the IC signal may include upmixing the received audio bitstream into a signal for a channel pair included in the single CPE, based on a channel level difference (CLD) included in an MPS212 payload; scaling the upmixed bitstream, based on the EQ values and the gain values; and mixing the scaled bitstream.

The generating of the IC signal may further include determining whether the IC signal for the single CPE is generated.

Whether the IC signal for the single CPE is generated may be determined based on whether the channel pair included in the single CPE belongs to a same IC group.

When both of the channel pair included in the single CPE are included in a left IC group, the IC signal may be output via only a left output channel among stereo output channels. When both of the channel pair included in the single CPE are included in a right IC group, the IC signal may be output via only a right output channel among the stereo output channels.

When both of the channel pair included in the single CPE are included in a center IC group or both of the channel pair included in the single CPE are included in a low frequency effect (LFE) IC group , the IC signal may be evenly output via a left output channel and a right output channel among stereo output channels.

The audio signal may be an immersive audio signal.

The generating of the IC signal may further include calculating an IC gain (ICG); and applying the ICG.

According to another aspect of the present invention, there is provided an apparatus for processing an audio signal, the apparatus including a receiver configured to receive an audio bitstream encoded via MPEG Surround 212 (MPS212); an internal channel (IC) signal generator configured to generate an IC signal for a single channel pair element (CPE), based on the received audio bitstream, equalization (EQ) values for MPS212 output channels defined in a format converter, and gain values for the MPS212 output channels; and a stereo output signal generator configured to generate stereo output channels, based on the generated IC signal.

The IC signal generator may be configured to: upmix the received audio bitstream into a signal for a channel pair included in the single CPE, based on a channel level difference (CLD) included in an MPS212 payload; scale the upmixed bitstream, based on the EQ values and the gain values; and mix the scaled bitstream.

The IC signal generator may be configured to determine whether the IC signal for the single CPE is generated.

Whether the IC signal is generated may be determined based on whether a channel pair included in the single CPE belongs to a same IC group.

When both of the channel pair included in the single CPE are included in a left IC group, the IC signal may be output via only a left output channel among stereo output channels. When both of the channel pair included in the single CPE are included in a right IC group, the IC signal may be output via only a right output channel among the stereo output channels.

When both of the channel pair included in the single CPE are included in a center IC group or both of the channel pair included in the single CPE are included in a low frequency effect (LFE) IC group, the IC signal may be evenly output via a left output channel and a right output channel among stereo output channels.

The audio signal may be an immersive audio signal.

The IC signal generator may be configured to calculate an IC gain (ICG) and apply the ICG.

According to another aspect of the present invention, there is provided a computer-readable recording medium having recorded thereon a computer program for executing the aforementioned method.

According to other embodiments of the present invention, there are provided other methods, other systems, and computer-readable recording media having recorded thereon a computer program for executing the methods.

According to the present invention, the number of channels input to a format converter is reduced by using internal channels (ICs), and thus, the complexity of the format converter can be reduced. In more detail, due to the reduction of the number of channels input to the format converter, a covariance analysis to be performed in the format converter is simplified, and thus, the complexity of the format converter is reduced.

BRIEF DESCRIPTION OF THE DRAWINGS

FIG. 11 illustrates Table 1 which shows an embodiment of a mixing matrix of a format converter that renders a 22.2 channel immersive audio signal into a stereo signal.

FIG. 12 illustrates Table 2 which shows an embodiment of a mixing matrix of a format converter that renders an 22.2 channel immersive audio signal into a stereo signal by using ICs.

FIG. 13 illustrates Table 5 which shows the locations of channels that are additionally defined according to IC types, according to an embodiment.

FIG. 14 illustrates Table 8 which shows a syntax of mpegh3daExtElementConfig( ), according to an embodiment.

FIG. 15 illustrates Table 9 which shows a syntax of usacExtElementType, according to an embodiment.

FIG. 16 illustrates Table 10 which shows a syntax of speakerLayoutType, according to an embodiment.

FIG. 17 illustrates Table 11 which shows a syntax of SpeakerConfig3d( ), according to an embodiment.

FIG. 18 illustrates Table 12 which shows a syntax of immersiveDownmixFlag, according to an embodiment.

Figure 1:
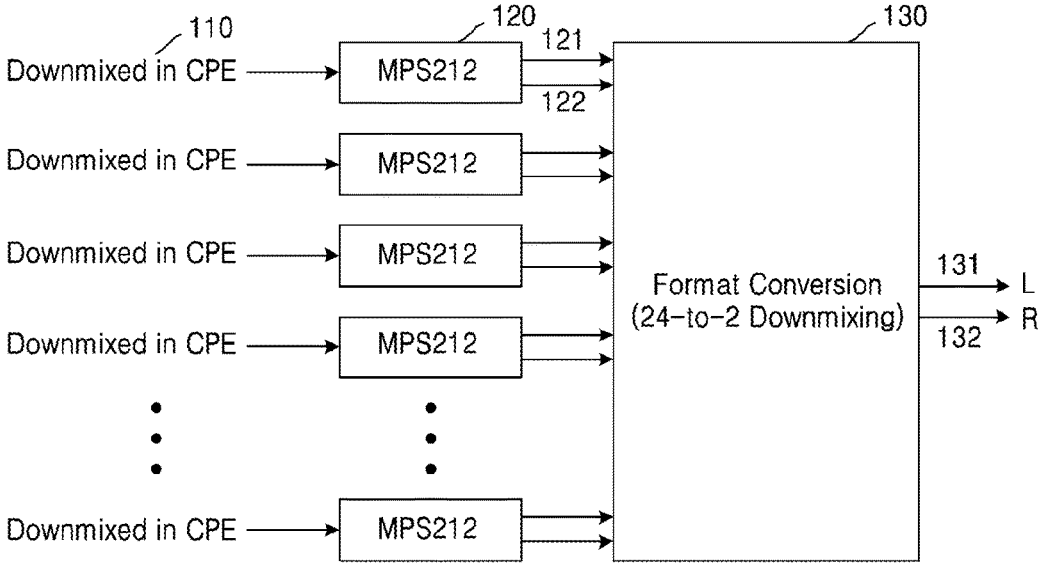
FIG. 1 is a block diagram of a decoding structure for format-converting 24 input channels into stereo output channels, according to an embodiment.

Table 1 shows an embodiment of a mixing matrix of a format converter that renders a 22.2 channel immersive audio signal into a stereo signal.

Table 2 shows an embodiment of a mixing matrix of a format converter that renders an 22.2 channel immersive audio signal into a stereo signal by using ICs.

Table 3 shows a CPE structure for configuring 22.2 channels by using ICs, according to an embodiment of the present invention.

Table 4 shows the types of ICs corresponding to decoder-input channels, according to an embodiment of the present invention.

Table 5 shows the locations of channels that are additionally defined according to IC types, according to an embodiment of the present invention.

Table 6 shows format converter output channels corresponding to IC types and a gain and an EQ index that are to be applied to each format converter output channel, according to an embodiment of the present invention.

Table 7 shows a syntax of ICGConfig, according to an embodiment of the present invention.

Table 8 shows a syntax of mpegh3daExtElement Config( ), according to an embodiment of the present invention.

Table 9 shows a syntax of usacExtElementType, according to an embodiment of the present invention.

Table 10 shows a syntax of speakerLayoutType, according to an embodiment of the present invention.

Table 11 shows a syntax of SpeakerConfig3d( ), according to an embodiment of the present invention.

Table 12 shows a syntax of immersiveDownmixFlag, according to an embodiment of the present invention.

Table 13 shows a syntax of SAOC3DgetNumChannels( ), according to an embodiment of the present invention.

Table 14 shows a syntax of a channel allocation order, according to an embodiment of the present invention.

Table 15 shows a syntax of mpegh3daChannelPairElementConfig( ), according to an embodiment of the present invention.

Table 16 shows a decoding scenario of MPS and SBR that is determined based on a channel element and a reproduction layout, according to an embodiment of the present invention.

BEST MODE

Representative features of the present invention to achieve the aforementioned goals are as follows.

A method of processing an audio signal includes receiving an audio bitstream encoded via MPEG Surround 212 (MPS212); generating an internal channel (IC) signal for a single channel pair element (CPE), based on the received audio bitstream, equalization (EQ) values for MPS212 output channels defined in a format converter, and gain values for the MPS212 output channels; and generating stereo output channels, based on the generated IC signal.

MODE OF THE INVENTION

Detailed descriptions of the present invention will now be made with reference to the attached drawings illustrating particular embodiments of the present invention. These embodiments are provided so that this disclosure will be thorough and complete, and will fully convey the concept of the present invention to one of ordinary skill in the art. It will be understood that various embodiments of the present invention are different from each other but are not exclusive with respect to each other.

For example, a particular shape, a particular structure, and a particular feature described in the specification may be changed from an embodiment to another embodiment without departing from the spirit and scope of the present invention. It will also be understood that a position or layout of each element in each embodiment may be changed without departing from the spirit and scope of the present invention. Therefore, the below detailed descriptions should be considered in a descriptive sense only and not for purposes of limitation, and the scope of the present invention should be defined in the appended claims and their equivalents.

Like reference numerals in the drawings denote like or similar elements throughout the specification. In the drawings, parts irrelevant to the description are omitted for simplicity of explanation, and like numbers refer to like elements throughout.

Hereinafter, the present invention will be described in detail by explain exemplary embodiments of the invention with reference to the attached drawings. The present invention may, however, be embodied in many different forms and should not be construed as being limited to the embodiments set forth herein.

Throughout the specification, when an element is referred to as being "connected" or "coupled" to another element, it can be directly connected or coupled to the other element, or can be electrically connected or coupled to the other element with intervening elements interposed therebetween. In addition, the terms "comprises" and/or "comprising" or "includes" and/or "including" when used in this specification, specify the presence of stated elements, but do not preclude the presence or addition of one or more other elements.

Terms used herein are defined as follows.

An internal channel (IC) is a virtual intermediate channel for use in format conversion, and takes into account a stereo output in order to remove unnecessary operations that are generated during MPS212 (MPEG Surround stereo) upmixing and format converter (FC) downmixing.

An IC signal is a mono signal that is mixed in a format converter in order to provide a stereo signal, and is generated using an IC gain (ICG).

IC processing denotes a process of generating an IC signal by using an MPS212 decoding block, and is performed in an IC processing block.

The ICG denotes a gain that is calculated from a channel level difference (CLD) value and format conversion parameters and is applied to an IC signal.

An IC group denotes the type of an IC that is determined based on a core codec output channel location, and the core codec output channel location and the IC group are defined in Table 4, which will be described later.

The present invention will now be described more fully with reference to the accompanying drawings, in which exemplary embodiments of the invention are shown.

FIG. 1 is a block diagram of a decoding structure for format-converting 24 input channels into stereo output channels, according to an embodiment.

When a bitstream of a multichannel input is delivered to a decoder, the decoder downmixes an input channel layout according to an output channel layout of a reproduction system. For example, when a 22.2 channel input signal that follows an MPEG standard is reproduced by a stereo channel output system as shown in FIG. 1, a format converter 130 included in a decoder downmixes an 24-input channel layout into a 2-output channel layout according to a format converter rule prescribed within the format converter 130.

The 22.2 channel input signal that is input to the decoder includes channel pair element (CPE) bitstreams 110 obtained by downmixing signals for two channels included in a single CPE. Because a CPE bitstream has been encoded via MPS212 (MPEG Surround based stereo), the CPE bitstream is decoded via MPS212 120. In this case, an LFE channel, namely, a woofer channel, is not included in the CPE bitstream. Accordingly, the 22.2 channel input signal that is input to the decoder includes bitstreams for 11 CPEs and bitstreams for two woofer channels.

When MPS212 decoding is performed with respect to CPE bitstreams that constitute the 22.2 channel input signal, two MPS212 output channels 121 and 122 for each CPE are generated and become input channels of the format converter 130. In such a case as FIG. 1, the number $N_{in}$ of input channels of the format converter 130, including the two woofer channels, is 24. Accordingly, the format converter 130 should perform 24*2 downmixing.

The format converter 130 performs a phase alignment according to a covariance analysis in order to prevent timbral distortion from occurring due to a difference between the phases of multichannel signals. In this case, because a covariance matrix has a $N_{in} \times N_{in}$ dimension, $(N_{in} \times (N_{in}-1)/2+N_{in}) \times 71band \times 2 \times 16 \times (48000/2048)$ complex multiplications should theoretically be performed to analyze the covariance matrix.

When the number $N_{in}$ of input channels is 24, four operations should be performed for one complex multiplication, and performance of about 64 Million Operations Per Second (MOPS) is required.

FIG. 11 illustrates Table 1 which shows an embodiment of a mixing matrix of a format converter that renders a 22.2 channel immersive audio signal into a stereo signal.

In the mixing matrix of Table 1, numbered 24 input channels are represented on a horizontal axis 140 and a vertical axis 150. The order of the numbered 24 input channels does not have any particular relevance in a covariance analysis. In the embodiment shown in Table 1, when each element of the mixing matrix has a value of 1 (as indicated by reference numeral 160), a covariance analysis is necessary, but, when each element of the mixing matrix has a value of 0 (as indicated by reference numeral 170), a covariance analysis may be omitted.

For example, in the case of input channels that are not mixed with one another during format conversion into a stereo output layout, such as, channels CM_M_L030 and CH_M_R030, elements in the mixing matrix that correspond to the not-mixed input channels have values of 0, and a covariance analysis between the not-mixed channels CM_M_L030 and CH_M_R030 may be omitted.

Accordingly, 128 covariance analyses of input channels that are not mixed with one another may be excluded from 24*24 covariance analyses.

In addition, because the mixing matrix is configured to be symmetrical according to input channels, the mixing matrix of Table 1 is divided with respect to a diagonal line into a lower portion 190 and an upper portion 180 and a covariance analysis for an area corresponding to the lower portion 190 may be omitted, in Table 1. Further, because a covariance analysis is performed only for portions in bold of the area corresponding to the upper portion 180, 236 covariance analyses are finally performed.

In the case that the value of the mixing matrix is 0 (in the case of channels not mixed with one another) and unnecessary covariance analyses are removed based on the symmetry of the mixing matrix, 236×71band×2×16×(48000/2048) complex multiplications should be performed for covariance analyses.

Thus, in this case, performance of 50 MOPS is required, and accordingly system load due to covariance analyses is reduced, as compared with the case where a covariance analysis is performed on the entire portion of a mixing matrix.

Figure 2:
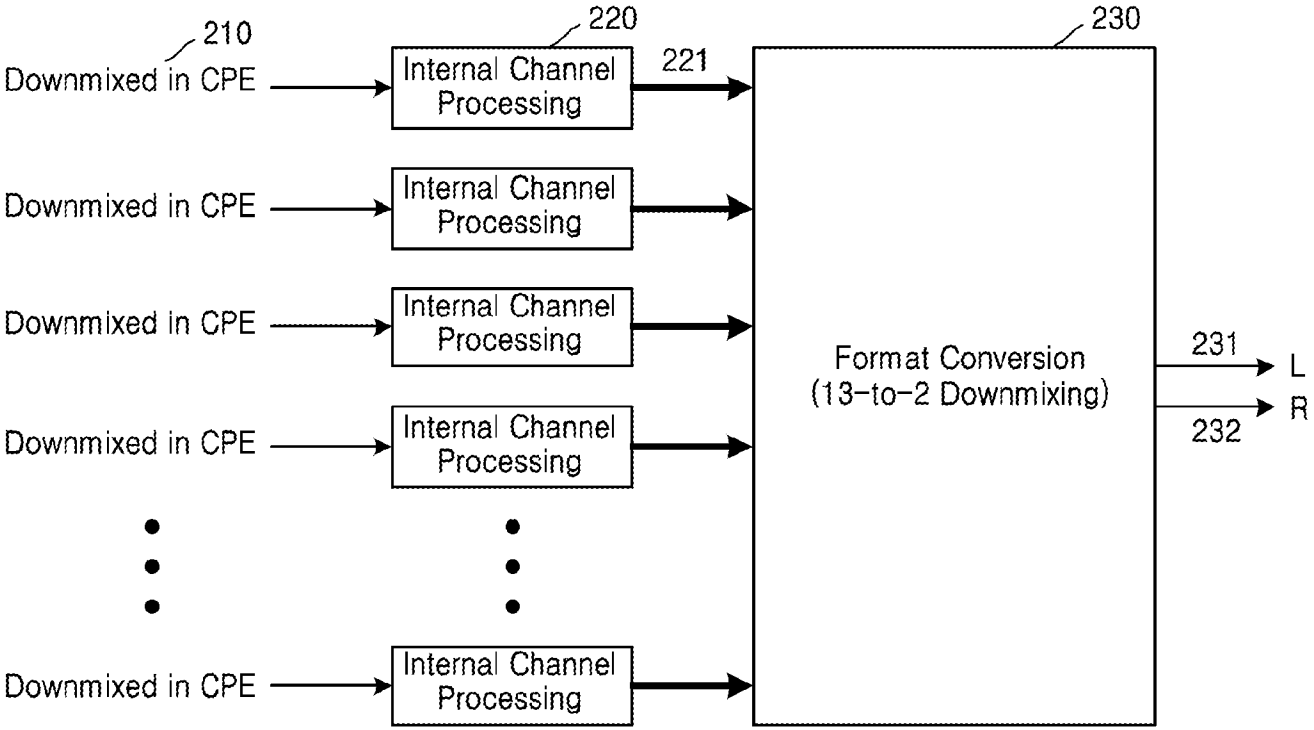
FIG. 2 is a block diagram of a decoding structure for format-converting a 22.2 channel immersive audio signal into a stereo output channel by using 13 internal channels (ICs), according to an embodiment.

FIG. 2 is a block diagram of a decoding structure for format-converting a 22.2 channel immersive audio signal into a stereo output channel by using 13 ICs, according to an embodiment.

MPEG-H 3D Audio uses a CPE in order to more efficiently deliver a multichannel audio signal in a restricted transmission environment. When two channels corresponding to a single channel pair are mixed into a stereo layout, an IC correlation (ICC) is set to be 1, and thus a decorrelator is not applied. Thus, the two channels have the same phase information.

In other words, when a channel pair included in each CPE is determined by taking into account a stereo output, upmixed channel pairs have the same panning coefficients, which will be described later.

A single IC is produced by mixing two in-phase channels included in a single CPE. A single IC signal is downmixed based on a mixing gain and an equalization (EQ) value that are based on a format converter conversion rule when two input channels included in an IC are converted into a stereo output channel. In this case, because the two channels included in a single CPE are in-phase channels, a process of aligning inter-channel phases after downmixing is not needed.

Stereo output signals of an MPS212 upmixer have no phase differences therebetween. However, this is not taken into account in the embodiment of FIG. 1, and thus complexity unnecessarily increases. When a reproduction layout is a stereo layout, the number of input channels of a format converter may be reduced by using a single IC instead of a CPE channel pair upmixed as an input of the format converter.

According to the embodiment illustrated in FIG. 2, instead that each CPE bitstream 210 undergoes MPS212 upmixing to produce two channels, each CPE bitstream 210 undergoes IC processing 220 to generate a single IC 221. In this case, because woofer channels do not form a CPE, each woofer channel signal becomes an IC signal.

According to the embodiment of FIG. 2, in the case of 22.2 channels, 13 ICs (i.e., $N_{in}$=13) including ICs for 11 CPEs for general channels and ICs for 2 woofer channels theoretically become input channels of a format converter 230. Accordingly, the format converter 230 performs 13*2 downmixing.

In such a stereo reproduction layout case, unnecessary processes generated during a process of upmixing via MPS212 and then downmixing via format conversion are further removed by using ICs, thereby further reducing complexity of a decoder.

When a mixing matrix $M_{Mix}$(ij)for two output channels i and j for a single CPE has a value of 1, an ICC $ICC^{l,m}$ may be set to be 1, and decorrelation and residual processing may be omitted.

An IC is defined as a virtual intermediate channel corresponding to an input of a format converter. As shown in FIG. 2, each IC processing block 220 generates an IC signal by using an MPS212 payload, such as a CLD, and rendering parameters, such as an EQ value and a gain value. The EQ and gain values denote rendering parameters for output channels of an MPS212 block that are defined in a conversion rule table of a format converter.

FIG. 12 illustrates Table 2 which shows an embodiment of a mixing matrix of a format converter that renders an 22.2 channel immersive audio signal into a stereo signal by using ICs.

Similar to Table 1, a horizontal axis and a vertical axis of the mixing matrix of Table 2 indicate indices of input channels, and the order of the indices does not mean a lot in a covariance analysis.

As described above, because a general mixing matrix has symmetry based on a diagonal line, the mixing matrix of Table 2 is also divided into an upper portion and a lower portion based on a diagonal line, and thus a covariance analysis for a selected portion among the two portions may be omitted. A covariance analysis for input channels that are not mixed during format conversion into a stereo output channel layout may also be omitted.

However, in contrast with the embodiment of Table 1, according to the embodiment of Table 2, 13 channels including 11 ICs, which are comprised of general channels, and 2 woofer channels are downmixed into stereo output channels, and the number of input channels of a format converter is 13.

As a result, according to an embodiment in which ICs are used, as in Table 2, 75 covariance analyses are performed, and performance of 19MOPS is theoretically required. Thus, as compared with when no ICs are used, load of the format converter due to a covariance analysis may be greatly reduced.

A downmix matrix $M_{Dmx}$ for downmixing is defined in the format converter, and a mixing matrix $M_{Mix}$ is calculated using $M_{Dmx}$ below:

```
M_Mix = zero N_in × N_in Matrix
for i = 1 to N_out
  for j = 1 to N_in
    set_j= 0
    If M_Dmx(i,j) > 0.0
        set_j= 1
    end
    for k = 1 to N_in
        set_k = 0
        if M_Dmx(i,k) > 0.0
          set_k = 1
      end
      if set_J = = 1 and set_k = = 1
```

-continued

```
            M_Mix(j,k)= 1
          end
        end
      end
    end
```

Each OTT decoding block outputs two channels corresponding to the channels numbers i and j, and, a case where the mixing matrix $M_{Mix}$ is 1 is set as $ICC^{l,m}=1$, and thus $H11_{OTT}^{l,m}$ and $H21_{OTT}^{l,m}$ of an upmix matrix $R_2^{l,m}$ are calculated. Thus, each OTT decoding block uses no decorrelators.

Table 3 shows a CPE structure for configuring 22.2 channels by using ICs, according to an embodiment of the present invention.

TABLE 3

| Input Channel | Element | Mixing Gain to L | Mixing Gain to R | Internal Channel |
|---|---|---|---|---|
| CH_M_000<br>CH_L_000 | CPE | 0.707 | 0.707 | ICH_A |
| CH_U_000<br>CH_T_000 | CPE | 0.707 | 0.707 | ICH_B |
| CH_M_180<br>CH_U_180 | CPE | 0.707 | 0.707 | ICH_C |
| CH_LFE2 | LFE | 0.707 | 0.707 | ICH_D |
| CH_LFE3 | LFE | 0.707 | 0.707 | ICH_E |
| CH_M_L135<br>CH_U_L135 | CPE | 1 | 0 | ICH_F |
| CH_M_L030<br>CH_L_L045 | CPE | 1 | 0 | ICH_G |
| CH_M_L090<br>CH_U_L090 | CPE | 1 | 0 | ICH_H |
| CH_M_L060<br>CH_U_L045 | CPE | 1 | 0 | ICH_I |
| CH_M_R135<br>CH_U_R135 | CPE | 0 | 1 | ICH_J |
| CH_M_R030<br>CH_L_R045 | CPE | 0 | 1 | ICH_K |
| CH_M_R090<br>CH_U_R090 | CPE | 0 | 1 | ICH_L |
| CH_M_R060<br>CH_U_R045 | CPE | 0 | 1 | ICH_M |

When a 22.2 channel bitstream has a structure as shown in Table 3, 13 ICs may be defined as ICH_A to ICH_M, and a mixing matrix for the 13 ICs may be determined as in Table 2.

A first column of Table 3 indicates indices for input channels, and a first row thereof indicates whether the input channels constitute a CPE, mixing gains to stereo channels, and indices of ICs.

For example, when CM_M_000 and CM_L_000 are an ICH_A IC included in a single CPE, both mixing gains to be applied to a left output channel and a right output channel, respectively, in order to upmix the CPE to stereo output channels have values of 0.707. In other words, signals upmixed to the left output channel and the right output channel are reproduced with the same size.

As another example, when CM_M_L135 and CM_U_L135 are an ICH_F IC included in a single CPE, a mixing gain to be applied to the left output channel has a value of 1 and a mixing gain to be applied to the right output channel has a value of 0, in order to upmix the CPE to stereo output channels. In other words, all signals are reproduced via only the left output channel, not via the right output channel.

On the other hand, when CM_M_R135 and CM_U_R135 are an ICH_F IC included in a single CPE, a mixing gain to be applied to the left output channel has a value of 0 and a mixing gain to be applied to the right output channel has a value of 1, in order to upmix the CPE to stereo output channels. In other words, all signals are reproduced via only the right output channel, not via the left output channel.

Figure 3:
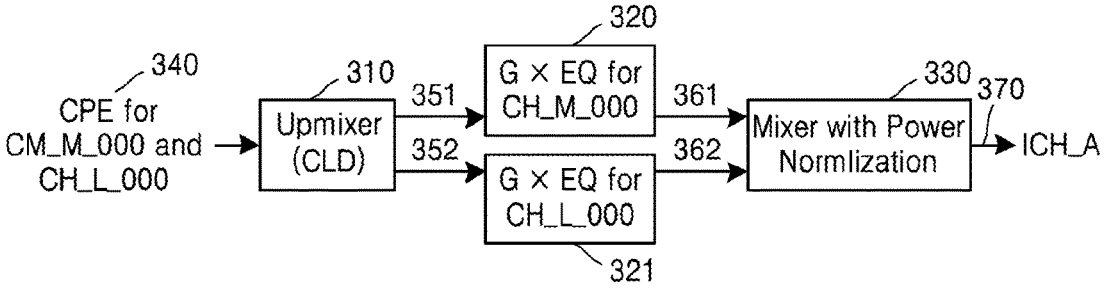
FIG. 3 illustrates an embodiment of generating a single IC from a single channel pair element (CPE).

FIG. 3 is a block diagram of an apparatus for generating a single IC from a single CPE, according to an embodiment.

An IC for a single CPE may be induced by applying format conversion parameters of a Quadrature Mirror Filter (QMF) domain, such as, a CLD, a gain, and EQ, to a downmixed mono signal.

The IC generating apparatus of FIG. 3 includes an upmixer 310, a scaler 320, and a mixer 330.

In the case where a CPE signal 340 obtained by dowmixing a signal for a channel pair of CH_M_000 and CH_L_000 is input, the upmixer 310 upmixes the CPE signal 340 by using a CLD parameter. The CPE signal 340 may be upmixed to a signal 351 for CH_M_000 and a signal 352 for CH_L_000 via the upmixer 310, and the upmixed signals 351 and 352 may maintain the same phases and may be mixed together in a format converter.

The CH_M_000 channel signal 351 and the CH_L_000 channel signal 352, which are results of the upmixing, are scaled in units of subbands by a gain and an EQ value corresponding to a conversion rule defined in the format converter, by using scalers 320 and 321, respectively.

When scaled signals 361 and 362 are generated as a result of the scaling with respect to the channel pair of CH_M_000 and CH_L_000, the mixer 330 mixes the scaled signals 361 and 362 and power-normalizes a result of the mixing to generate an IC signal ICH_A 370, which is an intermediate channel signal for format conversion.

In this case, ICs for a single channel element (SCE) and woofer channels, which are not upmixed by using a CLD, are the same as the original input channels.

Since a core codec output using ICs is performed in a hybrid QMF domain, a process of ISO IEC23308-3 10.3.5.2 is not performed. To allocate each channel of a core coder, an additional channel allocation rule and a downmix rule as shown in Tables 4-6 are defined.

Table 4 shows the types of ICs corresponding to decoder-input channels, according to an embodiment of the present invention.

TABLE 4

| Type | Channels | Panning (L, R) |
|---|---|---|
| Lfe | CH_LFE1, CH_LFE2, CH_LFE3 | (0.707, 0.707) |
| Center | CH_M_000, CH_L_000, CH_U_000, CH_T_000, CH_M_180, CH_U_180 | (0.707, 0.707) |
| Left | CH_M_L022, CH_M_L030, CH_M_L045, CH_M_L060, CH_M_L090, CH_M_L110, CH_M_L135, CH_M_L150, CH_L_L045, CH_U_L045, CH_U_L030, CH_U_L045, CH_U_L090, CH_U_L110, CH_U_L135, CH_M_LSCR, CH_M_LSCH | (1, 0) |
| Right | CH_M_R022, CH_M_R030, CH_M_R045, CH_M_R060, CH_M_R090, CH_M_R110, CH_M_R135, CH_M_R150, CH_L_R045, CH_U_R045, CH_U_R030, CH_U_R045, CH_U_R090, CH_U_R110, CH_U_R135, CH_M_RSCR, CH_M_RSCH | (0, 1) |

The ICs correspond to intermediate channels between the input channels of a core coder and a format converter, and include four types of ICs, namely, a woofer channel, a center channel, a left channel, and a right channel.

When different types of channels expressed as a CPE have the same IC type, the format converter has the same panning coefficient and the same mixing matrix, and thus can use an IC. In other words, when two channels included in a CPE have the same IC type, IC processing is possible, and thus a CPE needs to be configured with channels having the same IC type.

When a decoder-input channel corresponds to a woofer channel, namely, CH_LFE1, CH_LFE2, or CH_LFE3, the IC type of the decoder-input channel is determined as CH_I_LFE, which is a woofer channel.

When a decoder-input channel corresponds to a center channel, namely, CH_M_000, CH_L_000, CH_U_000, CH_T_000, CH_M_180, or CH_U_180, the IC type of the decoder-input channel is determined as CH_I_CNTR, which is a center channel.

When a decoder-input channel corresponds to a left channel, namely, CH_M_L022, CH_M_L030, CH_M_L045, CH_M_L060, CH_M_L090, CH_M_L110, CH_M_L135, CH_M_L150, CH_L_L045, CH_U_L045, CH_U_L030, CH_U_L045, CH_U_L090, CH_U_L110, CH_U_L135, CH_M_LSCR, or CH_M_LSCH, the IC type of the decoder-input channel is determined as CH_I_LEFT, which is a left channel.

When a decoder-input channel corresponds to a right channel, namely, CH_M_R022, CH_M_R030, CH_M_R045, CH_M_R060, CH_M_R090, CH_M_R110, CH_M_R135, CH_M_R150, CH_L_R045, CH_U_R045, CH_U_R030, CH_U_R045, CH_U_R090, CH_U_R110, CH_U_R135, CH_M_RSCR, or CH_M_RSCH, the IC type of the decoder-input channel is determined as CH_I_RIGHT, which is a right channel.

FIG. 13 illustrates Table 5 which shows the locations of channels that are additionally defined according to IC types, according to an embodiment of the present invention.

CH_I_LFE is a woofer channel and is located at an elevation angle of 0 deg, and CH_I_CNTR corresponds to a channel of which an elevation angle and an azimuth are all 0 deg. CH_I_LFET corresponds to a channel of which an elevation angle is 0 deg and an azimuth is at a sector between 30 deg and 60 deg on the left side, and CH_I_RIGHT corresponds to a channel of which an elevation angle is 0 deg and an azimuth is at a sector between 30 deg and 60 deg on the right side.

In this case, the locations of the newly-defined ICs are not relative locations between channels but absolute locations with respect to a reference point.

An IC may be applied to even a Quadruple Channel Element (QCE) comprised of a CPE pair, which will be described later.

An IC may be generated using two methods.

The first method is pre-processing in an MPEG-H 3D audio encoder, and the second method is post-processing in an MPEG-H 3D audio decoder.

When an IC is used in MPEG, Table 5 may be added as a new row to ISO/IEC 23008-3 Table 90.

Table 6 shows format converter output channels corresponding to IC types and a gain and an EQ index that are to be applied to each format converter output channel, according to an embodiment of the present invention.

TABLE 6

| Source | Destination | Gain | EQ_index |
|---|---|---|---|
| CH_I_CNTR | CH_M_L030, CH_M_R030 | 1.0 | 0 (off) |
| CH_I_LFE | CH_M_L030, CH_M_R030 | 1.0 | 0 (off) |
| CH_I_LEFT | CH_M_L030 | 1.0 | 0 (off) |
| CH_I_RIGHT | CH_M_L030 | 1.0 | 0 (off) |

In order to use an IC, an additional rule, such as Table 6, should be added to the format converter.

An IC signal is produced by taking into account gain and EQ values of the format converter. Accordingly, an IC signal may be produced using an additional conversion rule in which a gain value is 1 and an EQ index is 0, as shown in Table 6.

When an IC type is CH_I_CNTR corresponding to a center channel or CH_I_LFE corresponding to a woofer channel, output channels are CH_M_L030 and CH_M_R030. At this time, because the gain value is determined as 1, the EQ index is determined as 0, and the two stereo output channels are all used, each output channel signal should be multiplied by $1/\sqrt{2}$ in order to maintain power of an output signal.

When an IC type is CH_I_LEFT corresponding to a left channel, an output channel is CH_M_L030. At this time, because the gain value is determined as 1, the EQ index is determined as 0, and only a left output channel is used, a gain of 1 is applied to CH_M_L030, and a gain of 0 is applied to CH_M_R030.

When an IC type is CH_I_RIGHT corresponding to a right channel, an output channel is CH_M_R030. At this time, because the gain value is determined as 1, the EQ index is determined as 0, and only a right output channel is used, a gain of 1 is applied to CH_M_R030, and a gain of 0 is applied to CH_M_L030.

In this case, a general format conversion rule is applied to an SCE channel in which an IC and an input channel are the same.

When an IC is used in MPEG, Table 6 may be added as a new row to ISO/IEC 23008-3 Table 96.

Tables 7-15 show a portion of an existing standard that is to be changed to utilize an IC in MPEG.

Table 7 shows a syntax of ICGConfig, according to an embodiment of the present invention.

TABLE 7

| Syntax | No. of bits | Mnemonic |
|---|---|---|
| ICGConfig ( ) | | |
| { | | |
| if (ICGDisabledPresent) { | 1 | Uimsbf |
| for (elemIdx=0, elemCPE=0; elemIdx<numElements; ++elemIdx) | | |
| { | | |
| If (usacElementType[elemIdx] == ID_USAC_CPE) | | |
| { | | |

TABLE 7-continued

| Syntax | No. of bits | Mnemonic |
|---|---|---|
| ICGDisabledCPE[elemCPE]; | 1 | Uimsbf |
| elemCPE++; | | |
| } | | |
| } | | |
| } | | |
| if (ICGPreAppliedPresent) { | 1 | Uimsbf |
| for (elemIdx=0, elemCPE=0; elemIdx<numElements; ++elemIdx) | | |
| { | | |
| If (usacElementType[elemIdx] == ID_USAC_CPE) | | |
| { | | |
| ICGPreAppliedCPE[elemCPE]; | 1 | Uimsbf |
| elemCPE++; | | |
| } | | |
| } | | |
| } | | |
| } | | |

ICGconfig shown in Table 7 defines the types of a process that is to be performed in an IC processing block.

ICGDisabledPresent indicates whether at least one IC processing for CPEs is disabled by reason of channel allocation. In other words, ICGDisabledPresent is an indicator representing whether at least one ICGDisabledCPE has a value of 1.

ICGDisabledCPE indicates whether each IC processing for CPEs is disabled by reason of channel allocation. In other words, ICGDisabledCPE is an indicator representing whether each CPE uses an IC.

ICGPreAppliedPresent indicates whether at least one CPE has been encoded by taking into account an ICG.

ICGPreAppliedCPE is an indicator representing whether each CPE has been encoded by taking into account an ICG, namely, whether an ICG has been pre-processed in an encoder.

When ICGAppliedPresent is set as 1 for each CPE, ICGPreAppliedCPE, which is a 1-bit flag of ICGPreAppliedCPE, is read out. In other words, it is determined whether an ICG should be applied to each CPE, and, when it is determined that an ICG should be applied to each CPE, it is determined whether the ICG has been pre-processed in an encoder. If it is determined that the ICG has been pre-processed in the encoder, a decoder does not apply the ICG. On the other hand, if it is determined that the ICG has not been pre-processed in the encoder, the decoder applies the ICG.

When an immersive audio input signal is MPS212-encoded using a CPE or a QCE and an output layout is a stereo layout, a core codec decoder generates an IC signal in order to reduce the number of input channels of a format converter. In this case, IC signal generation is omitted for a CPE of which ICGDisabledCPE is set as 1. IC processing corresponds to a process of multiplying a decoded mono signal by an ICG, and the ICG is calculated from a CLD and format conversion parameters.

ICGDisabledCPE[n] indicates whether it is possible for an n-th CPE to undergo IC processing. When the two channels included in an n-th CPE belong to an identical channel group defined in Table 4, the n-th CPE is able to undergo IC processing, and ICGDisabledCPE[n] is set to be 0.

For example, when CH_M_L060 and CH_T_L045 among input channels constitute a single CPE, because the two channels belong to the same channel group, ICGDisabledCPE[n] may be set to be 0, and an IC of CH_I_LEFT may be generated. On the other hand, when CH_M_L060 and CH_M_000 among the input channels constitute a single CPE, because the two channels belong to different channel groups, ICGDisabledCPE[n] is set to be 1, and IC processing is not performed.

Regarding a QCE including a CPE pair, in a case (1) where a QCE is configured with four channels belonging to a single group or in a case (2) where a QCE is configured with two channels belonging to a group and two channels belonging to another group, IC processing is possible, and ICGDisableCPE[n] and ICGDisableCPE[n+1] are both set to be 0.

As an example in the case (1), when a QCE is configured with four channels of CH_M_000, CH_L_000, CH_U_000, and CH_T_000, IC processing is possible, and the IC type of the QCE is CH_I_CNTR. As an example in the case (2), when a QCE is configured with four channels of CH_M_L060, CH_U_L045, CH_M_R060, and CH_U_R045, IC processing is possible, and the IC types of the QCE are CH_I_LEFT and CH_I_RIGHT.

In cases other than the case (1) and (2), ICGDisableCPE[n] and ICGDisableCPE[n+1] for a CPE pair that constitutes a corresponding QCE should be both set to be 1.

When an encoder applies an ICG, complexity required by a decoder may be reduced, compared with when the decoder applies an ICG.

ICGPreAppliedCPE[n] of ICGConfig indicates whether an ICG has been applied to the n-th CPE in the encoder. If ICGPreAppliedCPE[n] is true, the IC processing block of the decoder bypasses a downmix signal for stereo-reproducing the n-th CPE. On the other hand, if ICGPreAppliedCPE[n] is false, the IC processing block of the decoder applies an ICG to the downmix signal.

If ICGDisableCPE[n] is 1, it is impossible to calculate an ICG for a corresponding QCE or CPE, and thus ICGPreApplied[n] is set to be 0. As for a QCE including a CPE pair, indices ICGPreApplied[n] and ICGPreApplied[n+1] for the two CPEs included in the QCE should have the same value.

A bitstream structure and a bitstream syntax that are to be changed or added for IC processing will now be described using Tables 8-16.

FIG. 14 illustrates Table 8 which shows a syntax of mpegh3daExtElementConfig( ), according to an embodiment of the present invention.

As shown in mpegh3daExtElementConfig( ) of Table 8, ICGConfig( ) may be called during a Configuration process to thereby obtain information about use or non-use of an IC and application or non-application of an ICG as in Table 7.

FIG. 15 illustrates Table 9 which shows a syntax of usacExtElementType, according to an embodiment of the present invention.

As shown in Table 9, in usacExtElementType, ID_EXT_ELE_ICG may be added for IC processing, and the value of ID_EXT_ELE_ICG may be 9.

FIG. 16 illustrates Table 10 which shows a syntax of speakerLayoutType, according to an embodiment of the present invention.

For IC processing, a speaker layout type speakerLayoutType for ICs should be defined. Table 10 shows the meaning of each value of speakerLayoutType.

When speakerLayoutType is 3, a loud speaker layout is signaled by means of an index LCChannelConfiguration. The index LCChannelConfiguration has the same layout as ChannelConfiguration, but has channel allocation orders for enabling an optimal IC structure using a CPE.

FIG. 17 illustrates Table 11 which shows a syntax of SpeakerConfig3d( ), according to an embodiment of the present invention.

When speakerLayoutType is 3 as described above, an embodiment uses the same layout as CICPspeakerLayoutIdx, but is different from CICPspeakerLayoutIdx in terms of optimal channel allocation ordering.

When speakerLayoutType is 3 and an output layout is a stereo layout, an input channel number Nin is changed to the number of an IC after a core codec.

FIG. 18 illustrates Table 12 which shows a syntax of immersiveDownmixFlag, according to an embodiment of the present invention.

By newly defining a speaker layout type for ICs, immersiveDownmixFlag should also be corrected. When immersiveDownmixFlag is 1, a sentence for processing the case where speakerLayoutType is 3 should be added as in Table 12.

Object spreading should satisfy the following requirements:

Local cloud speaker setting is signaled by LoudspeakerRendering( ), speakerLayoutType should be 0 or 3, CICPspeakerLayoutIdx has a value of 4, 5, 6, 7, 9, 10, 11, 12, 13, 14, 15, 16, 17, or 18.

Table 13 shows a syntax of SAOC3DgetNumChannels( ), according to an embodiment of the present invention.

SAOC3DgetNumChannels should be corrected to include the case where speakerLayoutType is 3, as shown in Table 13.

TABLE 13

| Syntax | No. of bits | Mnemonic |
|---|---|---|
| SAOC3DgetNumChannels(Layout) | | Note 1 |
| { | | |
| numChannels = numSpeakers; | | Note 2 |
| for (i = 0; i < numSpeakers: i++) { | | |
| if (Layout.isLFE[i] == 1) { | | |
| numChannels = numChannels − 1; | | |
| } | | |
| } | | |
| return numChannels; | | |
| } | | |

Note 1:

The function SAOC3DgetNumChannels( ) returns the number of available non-LFE channels numChannels.

Note 2:

numSpeakers is defined in Syntax of SpeakerConfig3d( ). If speakerLayoutType == 0 or speakerLayoutType == 3 numSpeakers represents the number of loudspeakers corresponding to the ChannelConfiguration value, CICPspeakerLayoutIdx, as defined in ISO/IEC 23001-8.

Table 14 shows a syntax of a channel allocation order, according to an embodiment of the present invention.

Table 14 indicates the number of channels, the order of the channels, and possible IC types according to a loud speaker layout or LCChannelConfiguration, as a channel allocation order that is newly defined for ICs.

TABLE 14

| Loudspeaker Layout Index or LCChannelConfiguration | Number of Channels | Channels (with ordering) | Possible Internal Channel Type |
|---|---|---|---|
| 1 | 1 | CH_M_ 000 | Center |
| 2 | 2 | CH_M_L030, | Left |
| | | CH_M_R030 | Right |
| 3 | 3 | CH_M_000, | Center |
| | | CH_M_L030, | Left |
| | | CH_M_R030 | Right |
| 4 | 4 | CH_M_000, CH_M180, | Center |
| | | CH_M_L030, | Left |
| | | CH_M_R030, | Right |
| 5 | 5 | CH_M_000, | Center |
| | | CH_M_L030, CH_M_L110, | Left |
| | | CH_M_R030, CH_M_R110 | Right |
| 6 | 6 | CH_M_000, | Center |
| | | CH_LFE1, | Lfe |
| | | CH_M_L030, CH_M_L110, | Left |
| | | CH_M_R030, CH_M_R110 | Right |
| 7 | 8 | CH_M_000, | Center |
| | | CH_LFE1, | Lfe |
| | | CH_M_L030, CH_M_L110, CH_M_L060, | Left |
| | | CH_M_R030, CH_M_R110, CH_M_R060 | Right |
| 8 | | n.a. | |
| 9 | 3 | CH_M_180, | Center |
| | | CH_M_L030, | Left |
| | | CH_M_R030 | Right |
| 10 | 4 | CH_M_L030, CH_M_L110, | Left |
| | | CH_M_R030, CH_M_R110 | Right |
| 11 | 7 | CH_M_000, CH_M_180 | Center |
| | | CH_LFE1, | Lfe |
| | | CH_M_L030, CH_M_L110, | Left |
| | | CH_M_R030, CH_M_R110 | Right |

TABLE 14-continued

| Loudspeaker Layout Index or LCChannelConfiguration | Number of Channels | Channels (with ordering) | Possible Internal Channel Type |
|---|---|---|---|
| 12 | 8 | CH_M_000, | Center |
| | | CH_LFE1, | Lfe |
| | | CH_M_L030, CH_M_L110, CH_M_L135, | Left |
| | | CH_M_R030, CH_M_R110, CH_M_R135 | Right |
| 13 | 24 | CH_M_000, CH_L_000, CH_U_000, | Center |
| | | CH_T_000, CH_M_180, CH_T_180, | |
| | | CH_LFE2, CH_LFE3, | Lfe |
| | | CH_M_L135, CH_U_L135, CH_M_L030, CH_L_L045, | Left |
| | | CH_M_L090, CH_U_L090, CH_M_L060, CH_U_L045, | |
| | | CH_M_R135, CH_U_R135, CH_M_R030, CH_L_R045, | Right |
| | | CH_M_R090, CH_U_R090, CH_M_R060, CH_U_R045 | |
| 14 | 8 | CH_M_000, | Center |
| | | CH_LFE1, | Lfe |
| | | CH_M_L030, CH_M_L110, CH_U_L030, | Left |
| | | CH_M_R030, CH_M_R110, CH_U_R030 | Right |
| 15 | 12 | CH_M_000, CH_U_180, | Center |
| | | CH_ LFE2, CH_LFE3, | Lfe |
| | | CH_M_L030, CH_M_L135, CH_M_L090, CH_U_L045, | Left |
| | | CH_M_R030, CH_M_R135, CH_M_R090, CH_U_R045 | Right |
| 16 | 10 | CH_M_000, | Center |
| | | CH_LFE1, | Lfe |
| | | CH_M_L030, CH_M_L110, CH_U_L030, CH_U_L110, | Left |
| | | CH_M_R030, CH_M_R110, CH_U_R030, CH_U_R110 | Right |
| 17 | 12 | CH_M_000, CH_U_000, CH_T_000 | Center |
| | | CH_LFE1, | Lfe |
| | | CH_M_L030, CH_M_L110, CH_U_L030, CH_U_L110, | Left |
| | | CH_M_R030, CH_M_R110, CH_U_R030, CH_U_R110, | Right |
| 18 | 14 | CH_M_000, CH_U_000, CH_T_000, | Center |
| | | CH_LFE1, | Lfe |
| | | CH_M_L030, CH_M_L110, CH_M_L150, | Left |
| | | CH_U_L030, CH_U_L110, | |
| | | CH_M_R030, CH_M_R110, CH_M_R150, | Right |
| | | CH_U_R030, CH_U_R110 | |
| 19 | 12 | CH_M_000, | Center |
| | | CH_LFE1, | Lfe |
| | | CH_M_L030, CH_M_L135, CH_M_L090, | Left |
| | | CH_U_L030, CH_U_L135, | |
| | | CH_M_R030, CH_M_R135, CH_M_R090, | Right |
| | | CH_U_R030, CH_U_R135 | |
| 20 | 14 | CH_M_000, | Center |
| | | CH_LFE1, | Lfe |
| | | CH_M_L030, CH_M_L135, CH_M_L090, CH_U_L045, | Left |
| | | CH_U_L135, CH_M_LSCR, | |
| | | CH_M_R030, CH_M_R135, CH_M_R090, CH_U_R045, | Right |
| | | CH_U_R135, CH_M_RSCR | |

Table 15 shows a syntax of mpegh3daChannelPairElementConfig( ), according to an embodiment of the present invention.

For IC processing, as shown in Table 15, when stereoConfigIndex is greater than 0, mpegh3da ChannelPairElementConfig ( ) should be corrected so that Mps212Config ( ) processing is followed by isInternal Channel Processed( ).

TABLE 15

| Syntax | No. of bits | Mnemonic |
|---|---|---|
| mpegh3daChannelPairElementConfig(sbrRatioIndex) | | |
| { | | |
| mpegh3daCoreConfig( ); | | |
| if (enhancedNoiseFilling) { | | |
| igfIndependentTiling; | 1 | bslbf |
| } | | |
| if(sbrRatioIndex > 0) { | | |
| SbrConfig( ); | | |
| stereoConfigIndex; | 2 | uimsbf |
| } else { | | |
| stereoConfigIndex = 0; | | |
| } | | |
| if (stereoConfigIndex > 0) { | | |

TABLE 15-continued

| Syntax | No. of bits | Mnemonic |
|---|---|---|
| Mps212Config(stereoConfigIndex); | | |
| isInternalChannelProcessed | 1 | uimsbf |
| } | | |
| qceIndex; | 2 | uimsbf |
| if(qceIndex > 0) { | | |
| shiftIndex0; | 1 | uimsbf |
| if(shiftIndex0 > 0) { | | |
| shiftChannel0; | nBits[1)] | |
| } | | |
| ) | | |
| shiftIndex1; | 1 | uimsbf |
| if(shiftIndex1 > 0) { | | |
| shiftChannel1; | nBits[1)] | |
| } | | |
| } | | |

[1)]nBits = floor(log2(numAudioChannels + numAudioObjects + numHOATransportChannels + numSAOC-TransportChannels − 1)) + 1

Figure 4:
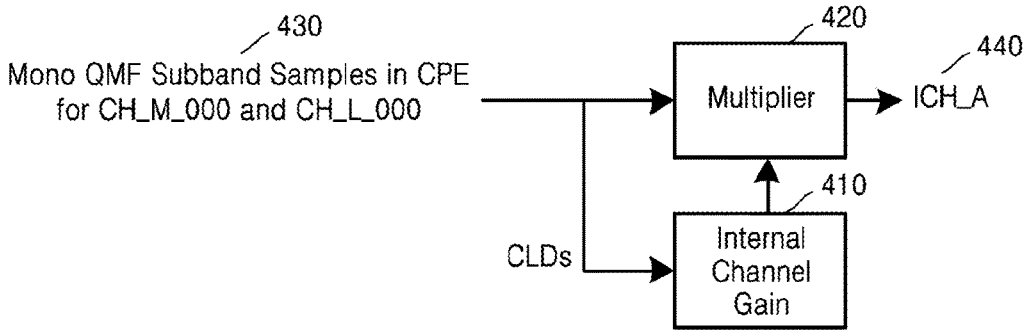
FIG. 4 is a detailed block diagram of an IC gain (ICG) application unit of a decoder to apply an ICG to an IC signal, according to an embodiment of the present invention.

FIG. 4 is a detailed block diagram of an ICG application unit of a decoder to apply an ICG to an IC signal, according to an embodiment of the present invention.

When conditions that speakerLayout is 3, isInternalProcessed is 0, and a reproduction layout is a stereo layout are met and thus the decoder applies an ICG, IC processing as in FIG. 4 is performed.

The ICG application unit illustrated in FIG. 4 includes an ICG acquirer 410 and a multiplier 420.

Assuming that an input CPE includes a channel pair of CH_M_000 and CH_L_000, when mono QMF subband samples 430 for the input CPE are input, the ICG acquirer 410 acquires an ICG by using CLDs. The multiplier 420 acquires an IC signal ICH_A 440 by multiplying the received mono QMF subband samples 430 by the acquired ICG.

An IC signal may be simply re-organized by multiplying mono QMF subband samples for a CPE by an ICG $G_{lCH}^{l,m}$, wherein l indicates a time index and m indicates a frequency index.

The ICG $G_{lCH}^{l,m}$ is defined as in [Equation 1]:

$$G_{lCH}^{l,m} = \sqrt{\frac{\left(c_{left}^{l,m} \times G_{left} \times G_{EQ,left}^{m}\right)^2 + \left(c_{right}^{l,m} \times G_{right} \times G_{EQ,right}^{m}\right)^2}{\left(c_{left}^{l,m} \times G_{left} \times G_{EQ,left}^{m} + c_{right}^{l,m} \times G_{right} \times G_{EQ,right}^{m}\right)^2}} \times$$

where $C_{left}^{l,m}$ and $C_{right}^{l,m}$, indicate panning coefficients of a CLD, $G_{left}$ and $G_{right}$ indicate gains defined in a format conversion rule, and $G_{EQ,left}^{m}$ and $G_{EQ,right}^{m}$ indicate gains of an m-th band of an EQ value defined in the format conversion rule.

Figure 5:
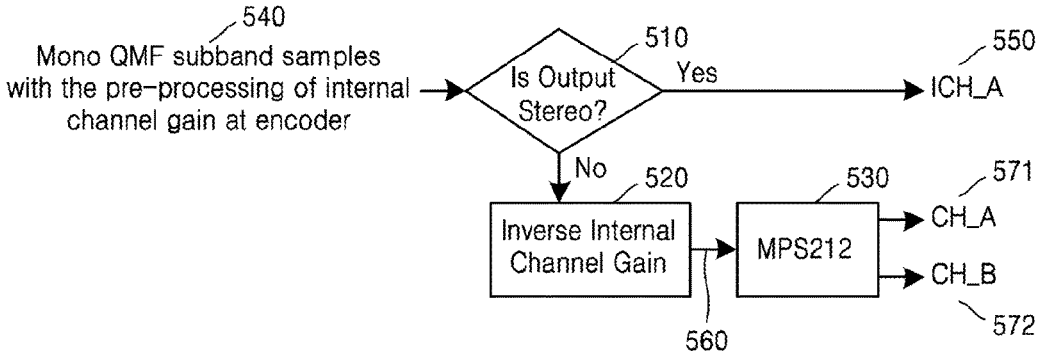
FIG. 5 is a block diagram illustrating decoding when an encoder pre-processes an ICG, according to an embodiment of the present invention.

FIG. 5 is a block diagram illustrating decoding when an encoder pre-processes an ICG, according to an embodiment of the present invention.

When conditions that speakerLayout is 3, isInternalProcessed is 1, and a reproduction layout is a stereo layout are met and thus the encoder applies and transmits an ICG, IC processing as in FIG. 5 is performed.

When the output layout is a stereo layout, an MPEG-H 3D audio encoder pre-processes an ICG corresponding to a CPE so that a decoder bypasses MPS212, and thus complexity of the decoder may be reduced.

However, when the output layout is not a stereo layout, the MPEG-H 3D audio encoder does not perform IC processing, and thus the decoder needs to perform a process of multiplying an inverse ICG $1/G_{lCH}^{l,m}$ and performing MPS212 in order to achieve decoding, as in FIG. 5.

Similar to FIGS. 3 and 4, it is assumed that an input CPE includes a channel pair of CH_M_000 and CH_L_000. When mono QMF subband samples 540 with an ICG pre-processed in the encoder are input, the decoder determines whether the output layout is a stereo layout, as indicated by reference numeral 510.

When the output layout is a stereo layout, an IC is used, and thus the decoder outputs the received mono QMF subband samples 540 as an IC signal for an IC ICH_A 550. On the other hand, when the output layout is not a stereo layout, an IC is not used during IC processing, and thus the decoder performs an inverse ICG process 520 to restore an IC processed signal as indicated by reference numeral 560, and upmixes the restored signal via MPS212 as indicated by reference numeral 530 to thereby output a signal for CH_M_000 571 and a signal for CH_L_000 572.

Because load due to a covariance analysis in a format converter becomes a problem when the number of input channels is large and the number of output channels is small, when the output layout is a stereo layout, MPEG-H Audio has largest decoding complexity.

On the other hand, when an output layout is not a stereo layout, the number of operations that are added to multiply an inverse ICG is (5 multiplications, 2 additions, one division, one extraction of a square root ≈55 operations)×(71 bands)×(2 parameter sets)×(48000/2048)×(13 ICs) in the case of two sets of CLDs per frame, and thus becomes approximately 2.4 MOPS and does not serve as a large load on a system.

After an IC is generated, QMF subband samples of the IC, the number of ICs, and the types of the ICs are transmitted to a format converter, and the size of a covariance matrix in the format converter depends on the number of ICs.

Table 16 shows a decoding scenario of MPEG Surround (MPS) and spectral band replication (SBR) that is determined based on a channel element and a reproduction layout, according to an embodiment of the present invention.

TABLE 16

| Reproduction Layout | Element | Order of MPS and SBR |
|---|---|---|
| Stereo | CPE | An MPS after mono SBR |
| Stereo | CPE | An MPS before stereo SBR |
| Stereo | QCE | Two MPS before two stereo SBR |
| Non-stereo | CPE/QCE | Independent of the order |

MPS is a technique of encoding a multichannel audio signal by using ancillary data comprised of spatial cue parameters that represent a downmix mixed to a minimal channel (mono or stereo) and perceptual characteristics of a human with respect to a multichannel audio signal.

An MPS encoder receives N multichannel audio signals and extracts, as the ancillary data, a spatial parameter that is expressed as, for example, a difference between sound volumes of two ears based on a binaural effect and a correlation between channels. Since the extracted spatial parameter is a very small amount of information (no more than 4 kbps per channel), a high-quality multichannel audio may be provided even in a bandwidth capable of providing only a mono or stereo audio service.

The MPS encoder also generates a downmix signal from the received N multichannel audio signals, and the generated downmix signal is encoded via, for example, MPEG USAC, which is an audio compression technique, and is transmitted together with the spatial parameter.

At this time, the N multichannel audio signals received by the MPS encoder are separated into frequency bands by an analysis filter bank. Representative methods of separating a frequency domain into subbands include Discrete Fourier Transform (DFT) or use of a QMF. In MPEG Surround, a QMF is used to separate a frequency domain into subbands with low complexity. When a QMF is used, compatibility with SBR may be ensured, and thus more efficient encoding may be performed.

SBR is a technique of copying and pasting a low frequency band to a high frequency band, which a human is relatively hard to sense, and parameterizing and transmitting information about a high-frequency band signal. Thus, according to SBR, a wide bandwidth may be achieved at a low bitrate. SBR is mainly used in a codec having a high compressibility rate and a low bitrate, and is hard to express harmonics due to loss of some information of a high-frequency band. However, SBR provides a high restoration rate within an audible frequency.

SBR for use in IC processing is the same as ISO/IEC 23003-3:2012 except for a difference in a domain that is processed. SBR of ISO/IEC 23003-3:2012 is defined in a QMF domain, but an IC is processed in a hybrid QMF domain. Accordingly, when the number of indices of a QMF domain is k, the number of frequency indices for an overall SBR process with respect to ICs is k+7.

Figure 6:
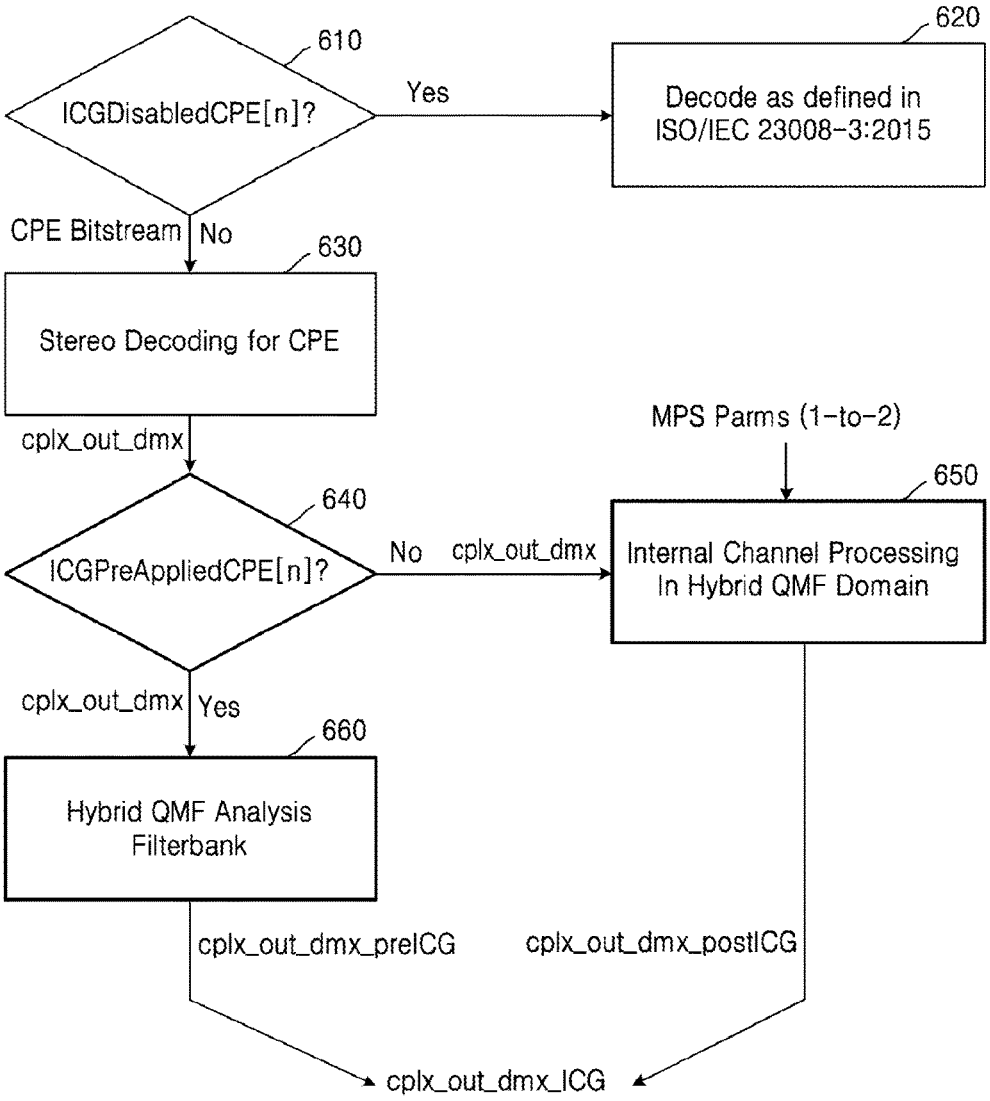
FIG. 6 is a flowchart of an IC processing method in a structure for performing mono spectral band replication (SBR) decoding and then performing MPEG Surround (MPS) decoding when a CPE is output via a stereo reproduction layout, according to an embodiment of the present invention.

An embodiment of a decoding scenario of performing mono SBR decoding and then performing MPS decoding when a CPE is output via a stereo reproduction layout is illustrated in FIG. 6.

Figure 7:
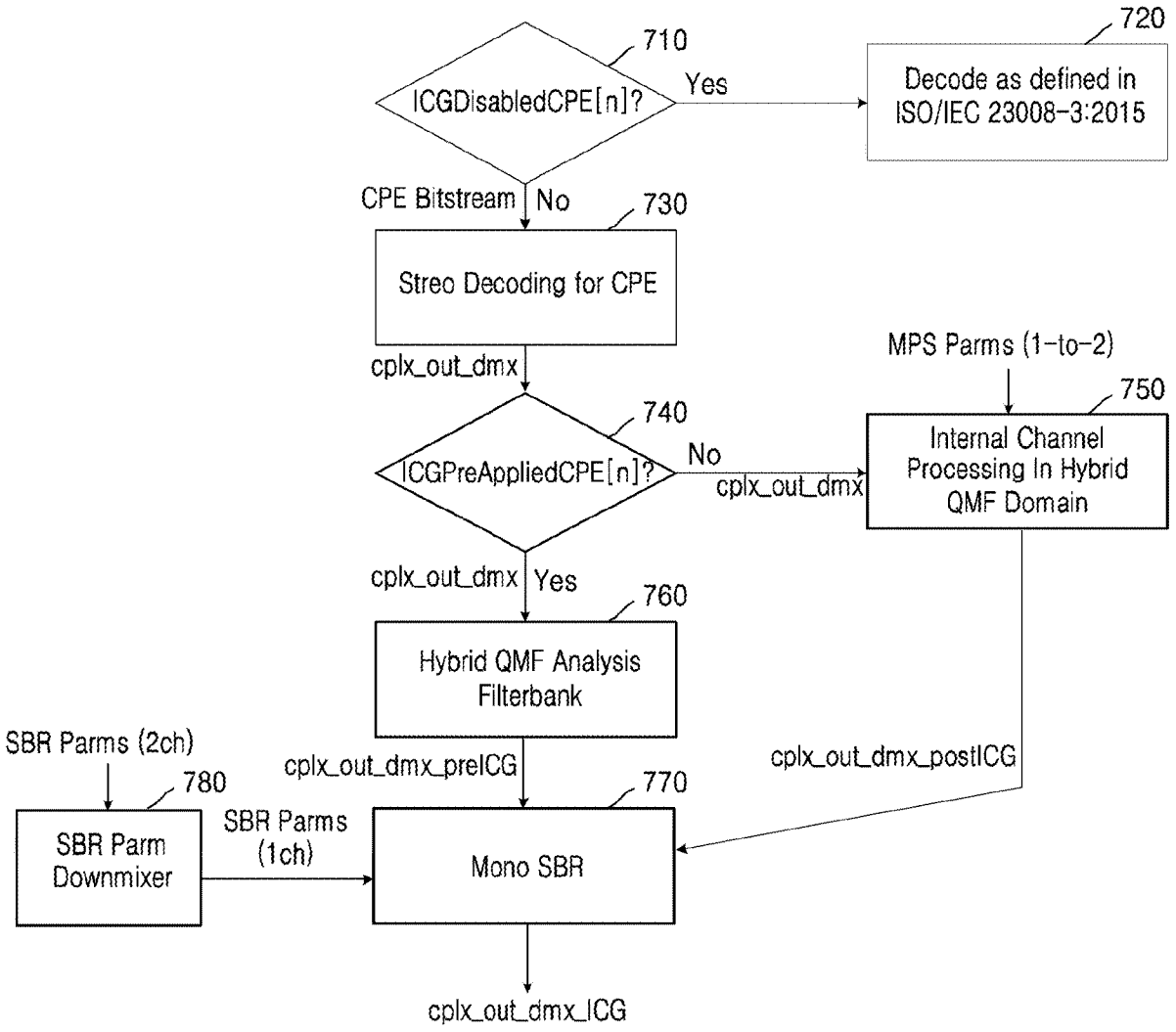
FIG. 7 is a flowchart of an IC processing method in a structure for performing MPS decoding and then performing stereo SBR decoding when a CPE is output via a stereo reproduction layout, according to an embodiment of the present invention.

An embodiment of a decoding scenario of performing MPS decoding and then performing stereo SBR decoding when a CPE is output to a stereo reproduction layout is illustrated in FIG. 7.

Figure 8:
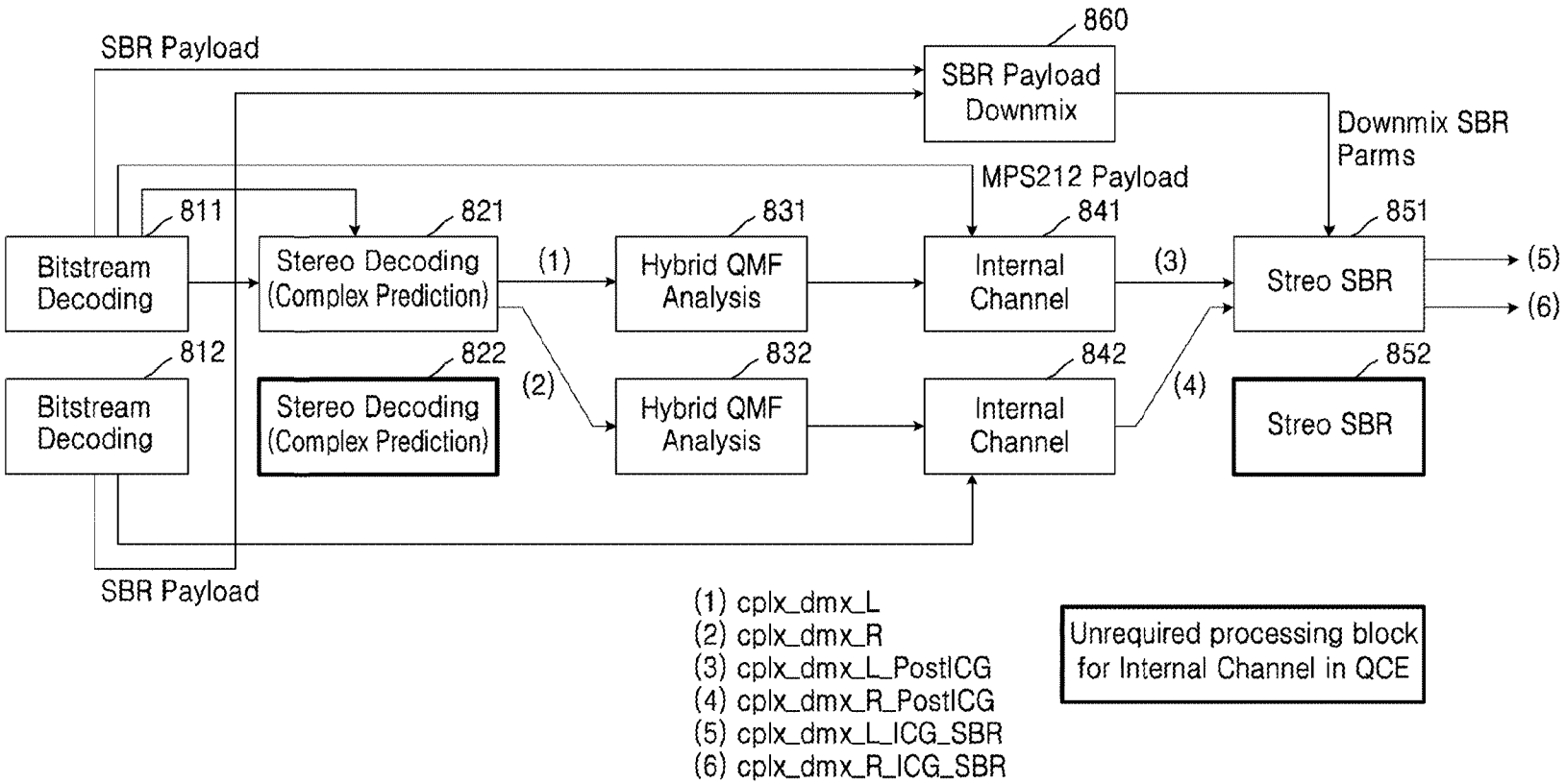
FIG. 8 is a block diagram of an IC processing method in a structure using stereo SBR when a Quadruple Channel Element (QCE) is output via a stereo reproduction layout, according to an embodiment of the present invention.
Figure 9:
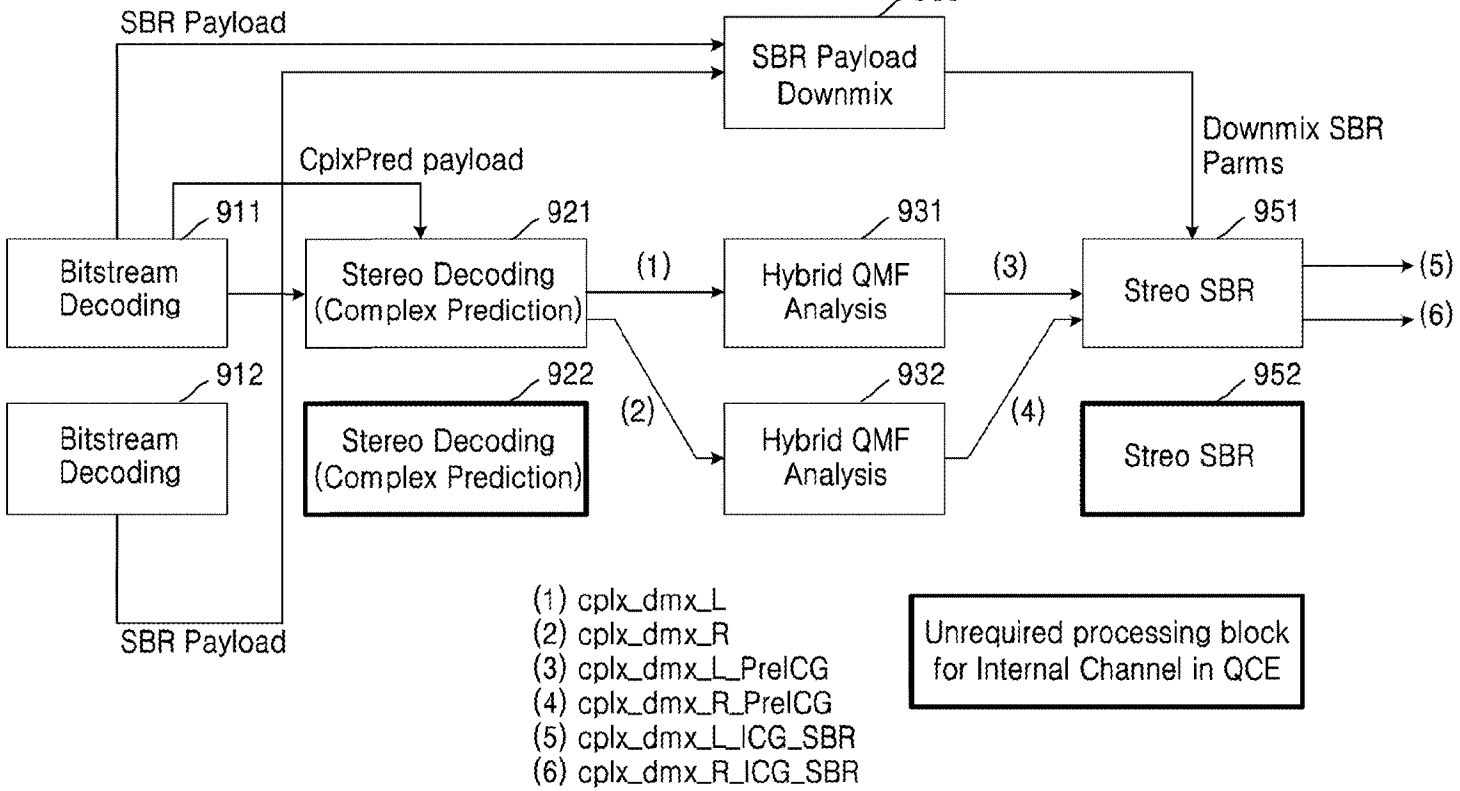
FIG. 9 is a block diagram of an IC processing method in a structure using stereo SBR when a QCE is output via a stereo reproduction layout, according to another embodiment of the present invention.

An embodiment of a decoding scenario of performing MPS decoding on a CPE pair and then performing stereo SBR decoding on each decoded signal when a QCE is output via a stereo reproduction layout is illustrated in FIGS. 8 and 9.

When a reproduction layout via which a CPE or a QCE is output is not a stereo layout, the order of performing MPS decoding and SBR decoding does not matter.

CPE signals encoded via MPS212, which are processed by a decoder, are defined as follows:

cplx_out_dmx[] is a CPE downmix signal obtained via complex prediction stereo decoding.

cplx_out_dmx_preICG[] is a mono signal to which an ICG has already been applied in an encoder, via complex prediction stereo decoding and hybrid QMF analysis filter bank decoding in a hybrid QMF domain.

cplx_out_dmx_postICG[] is a mono signal which have undergone complex prediction stereo decoding and IC processing in a hybrid QMF domain and to which an ICG is to be applied in a decoder.

cplx_out_dmx_ICG[] is a fullband IC signal in a hybrid QMF domain.

QCE signals encoded via MPS212, which are processed by a decoder, are defined as follows:

cplx_out_dmx_L[] is a first channel signal of a first CPE that has undergone complex prediction stereo decoding.

cplx_out_dmx_R[] is a second channel signal of the first CPE that has undergone complex prediction stereo decoding.

cplx_out_dmx_L_preICG[] is a first ICG-pre-applied IC signal in a hybrid QMF domain.

cplx_out_dmx_R_preICG[] is a second ICG-pre-applied IC signal in a hybrid QMF domain.

cplx_out_dmx_L_postICG[] is a first ICG-post-applied IC signal in a hybrid QMF domain.

cplx_out_dmx_R_postICG[] is a second ICG-post-applied IC signal in a hybrid QMF domain.

cplx_out_dmx_L_ICG_SBR is a first fullband decoded IC signal including downmixed parameters for 22.2-to-2 format conversion and a high frequency component generated by SBR.

cplx_out_dmx_R_ICG_SBR is a second fullband decoded IC signal including downmixed parameters for 22.2-to-2 format conversion and a high frequency component generated by SBR.

FIG. 6 is a flowchart of an IC processing method in a structure for performing mono SBR decoding and then performing MPS decoding when a CPE is output via a stereo reproduction layout, according to an embodiment of the present invention.

When a CPE bitstream is received, use or non-use of a CPE is first determined via an ICGDisabledCPE[n] flag, in operation 610.

When ICGDisabledCPE[n] is true, the CPE bitstream is decoded as defined in ISO/IEC 23008-3, in operation 620. On the other hand, when ICGDisabledCPE[n] is false, mono SBR is performed on the CPE bitstream when SBR is necessary, and stereo decoding is performed thereon to generate a downmix signal cplx_out_dmx, in operation 630.

In operation 640, it is determined whether an ICG has already been applied in an encoder end, via ICGPreAppliedCPE.

When ICGPreAppliedCPE[n] is false, the downmix signal cplx_out_dmx undergoes IC processing in the hybrid QMF domain, in operation 650, to thereby generate an ICG-post-applied downmix signal cplx_out_dmx_postICG. In operation 650, MPS parameters are used to calculate the ICG. A linear CLD value dequantized for a CPE is calculated by ISO/IEC 23008-3, and the ICG is calculated using Equation 2.

The ICG-post-applied downmix signal cplx_out_dmx_postICG is generated by multiplying the downmix signal cplx_out_dmx by the ICG calculated using Equation 2:

$$G_{ICH}^{l,m} = \sqrt{\left(c_{left}^{l,m} \times G_{left} \times G_{EQ,left}^{m}\right)^2 + \left(c_{right}^{l,m} \times G_{right} \times G_{EQ,right}^{m}\right)^2}$$

In Equation 2, $c_{left}^{l,m}$ and $c_{right}^{l,m}$ indicate a dequantized linear CLD value of an l-th time slot and an m-th hybrid QMF band fir a CPE signal, $G_{left}$ and $G_{right}$ indicate the values of gain columns for output channels defined in ISO/IEC 23008-3 table 96, namely, in a format conversion rule table, and $G^m_{EQ,left}$ and $G^m_{EQ,right}$ indicate gains of m-th bands of EQ values for the output channels defined in the format conversion rule table.

When ICGPreAppliedCPE[n] is true, the downmix signal cplx_out_dmx is analyzed, in operation 660, to acquire an ICG-pre-applied downmix signal cplx_out_dmx_preICG.

According to setting of ICGPreApplied CPE[n], the signal cplx_out_dmx_preICG or cplx_out_dmx_postICG becomes a final IC processed output signal cplx_out_dmx_ICG.

FIG. 7 is a flowchart of an IC processing method of performing MPS decoding and then performing stereo SBR decoding when a CPE is output via a stereo reproduction layout, according to an embodiment of the present invention.

According to the embodiment of FIG. 7, in contrast with the embodiment of FIG. 6, because MPS decoding is followed by SBR decoding, stereo SBR decoding is performed when ICs are not used. On the other hand, when ICs are used, mono SBR is performed, and, to this end, parameters for stereo SBR are downmixed.

Accordingly, compared with FIG. 6, the method of FIG. 7 further includes an operation 780 of generating SBR parameter for one channel by downmixing SBR parameters for two channels and an operation 770 of performing mono SBR by using the generated SBR parameters, and cplx_out_dmx_ICG having undergone mono SBR becomes a final IC processed output signal cplx_out_dmx_ICG.

In an operation layout as in FIG. 7, because a high-frequency component is extended due to execution of SBR after IC processing, the signal cplx_out_dmx_preICG or the signal cplx_out_dmx_postICG corresponds to a band-limited signal. An SBR parameter pair for an upmixed stereo signal should be downmixed in a parameter domain in order to extend the bandwidth of the band-limited IC signal cplx_out_dmx_preICG or cplx_out_dmx_postICG.

An SBR parameter downmixer should include a process of multiplying high frequency bands extended due to SBR by an EQ value and a gain parameter of a format converter. A method of downing SBR parameters will be described in detail later.

FIG. 8 is a block diagram of an IC processing method in a structure using stereo SBR when a QCE is output via a stereo reproduction layout, according to an embodiment of the present invention.

The embodiment of FIG. 8 is a case where both ICGPreApplied[n] and ICGPreApplied[n+1] are 0, namely, an embodiment of a method of applying an ICG in a decoder.

Referring to FIG. 8, overall decoding is conducted in the order of bitstream decoding 810, stereo decoding 820, a hybrid QMF analysis 830, IC processing 840, and stereo SBR 850.

When bitstreams for the two CPEs included in a QCE undergo bitstream decoding 811 and bitstream decoding 812, respectively, SBR payloads, MPS212 payloads, and a CplxPred payload are extracted from decoded signals corresponding to results of the bitstream decoding.

Stereo decoding 821 is performed using the CplxPred payload, and stereo-decoded signals cplx_dmx_L and cplx_dmx_R undergo hybrid QMF analyses 831 and 832, respectively, are transmitted as input signals of IC processing units 841 and 842, respectively.

At this time, generated IC signals cplx_dmx_L_PostICG and cplx_dmx_R_PostICG are band-limited signals. Accordingly, the two IC signals undergo stereo SBR 851 by using downmix SBR parameters obtained by downmixing the SBR payloads extracted from the bitstreams for the two CPEs. The high frequencies of the band-limited IC signals are extended via the stereo SBR 851, and thus fullband IC processed output signals cplx_dmx_L_ICG and cplx_dmx_R_ICG are generated.

The downmix SBR parameters are used to extend the bands of the band-limited IC signals to generate full band IC signals.

As such, when ICs for a QCE are used, only one stereo decoding block and only one stereo SBR block are used, and thus a stereo decoding block 822 and a stereo SBR block 852 may be omitted. In other words, the case of FIG. 7 achieves a simple decoding structure by using a QCE, compared with when each CPE is processed.

FIG. 9 is a block diagram of an IC processing method in a structure using stereo SBR when a QCE is output via a stereo reproduction layout, according to another embodiment of the present invention.

The embodiment of FIG. 9 is a case where both ICGPreApplied[n] and ICGPreApplied[n+1] are 1, namely, an embodiment of a method of applying an ICG in an encoder.

Referring to FIG. 9, overall decoding is conducted in the order of bitstream decoding 910, stereo decoding 920, a hybrid QMF analysis 930, and stereo SBR 950.

When the encoder has applied an ICG, a decoder does not perform IC processing, and thus the method of FIG. 9 omits the IC processing blocks 841 and 842 of FIG. 8. The other processes of FIG. 9 are similar to those of FIG. 8, and the repeated descriptions thereof will be omitted here.

Stereo-decoded signals cplx_dmx_L and cplx_dmx_R undergo hybrid QMF analyses 931 and 932, respectively, and are then transmitted as input signals of a stereo SBR block 951. After the stereo-decoded signals cplx_dmx_L and cplx_dmx_R pass through the stereo SBR block 951, fullband IC processed output signals cplx_dmx_L_ICG and cplx_dmx_R_ICG are generated.

When output channels are not stereo channels, use of ICs may not be appropriate. Accordingly, when the encoder has applied an ICG, if output channels are not stereo channels, the decoder should apply an inverse ICG.

In this case, the decoding order of MPS and SBR does not matter as shown in Table 8, but a scenario of performing mono SBR decoding and then performing MPS212 decoding will be described for convenience of explanation.

The inverse ICG IG is calculated using MPS parameters and format conversion parameters, as shown in Equation 3:

$$IG^{l,m}_{ICH} = \frac{1}{\sqrt{\left(c^{l,m}_{left} \times G_{left} \times G^m_{EQ,left}\right)^2 + \left(c^{l,m}_{right} \times G_{right} \times G^m_{EQ,right}\right)^2}}$$

where $c_{left}^{l,m}$ and $c_{right}^{l,m}$ indicate a dequantized linear CLD value of an l-th time slot and an m-th hybrid QMF band fir a CPE signal, $G_{left}$ and $G_{right}$ indicate the values of gain columns for output channels defined in ISO/IEC 23008-3 table 96, namely, in a format conversion rule table, and $G_{EQ,left}^m$ and $G_{EQ,right}^m$ indicate gains of m-th bands of EQ values for the output channels defined in the format conversion rule table.

If ICGPreAppliedCPE[n] is true, an n-th cplx_dmx should be multiplied by the inverse ICG before passing through an MPS block, and the remaining decoding processes should follow ISO/IEC 23008-3.

When a decoder uses an IC processing block or an encoder pre-processes an ICG, and an output layout is a stereo layout, a band-limited IC signal instead of an MPS-upmixed stereo/quad channel signal for CPE/QCE is generated in an end before an SBR block.

Because SBR payloads have been encoded via stereo SBR for the MPS-upmixed stereo/quad channel signal, stereo SBR payloads should be downmixed by being multiplied by a gain and an EQ value of a format converter in a parameter domain in order to achieve IC processing.

A method of parameter-downmixing stereo SBR will now be described in detail.

(1) inverse filtering

An inverse filtering mode is selected by allowing stereo SBR parameters to have maximum values in each noise floor band.

This is achieved using [Equation 4]:

$$\text{for } (i = 0;\ i < N_Q;\ i{+}{+})$$

$$\text{bs_invf_mode}_{Downmixed}(i) = \text{MAX}(\text{bs_invf_mode}_{ch1}(i),\ \text{bs_invf_mode}_{ch2}(i))$$

$$\begin{pmatrix} ch1 \\ ch2 \end{pmatrix} = \begin{cases} \begin{pmatrix} \text{Left of } CPE1 \\ \text{Left of } CPE2 \end{pmatrix} \text{in case of Cplx_out_dmx_L} \\ \begin{pmatrix} \text{Right of } CPE1 \\ \text{Right of } CPE2 \end{pmatrix} \text{in case of Cplx_out_dmx_R} \end{cases},$$

(2) additional harmonics

A sound wave including a basic frequency f and odd-numbered harmonics 3f, 5f, 7f, . . . of the basic frequency f has a half-wave symmetry. However, a sound wave including even-numbered harmonics 0f, 2f, . . . of the basic frequency f does not have a symmetry. On the contrary, a non-linear system that causes a sound source waveform change other than simple scaling or movement generates additional harmonics, and thus harmonic distortion occurs.

The additional harmonics are a combination of additional sine waves, and may be expressed as in Equation 5:

$$\text{for } (i{=}0;\ i{<}N_{High};\ i{+}{+})$$

$$\text{bs_add_harmonic}_{Downmixed}(\text{i}) = \text{OR}(\text{bs_add_harmonic}_{ch1}(\text{i}),\ \text{bs_add_harmonic}_{ch2}(\text{i}))$$

(3) envelope time borders

FIGS. 10A, 10B, 10C, and 10D illustrate a method of determining a time border, which is an SBR parameter, according to an embodiment of the present invention.

Figure 10A:
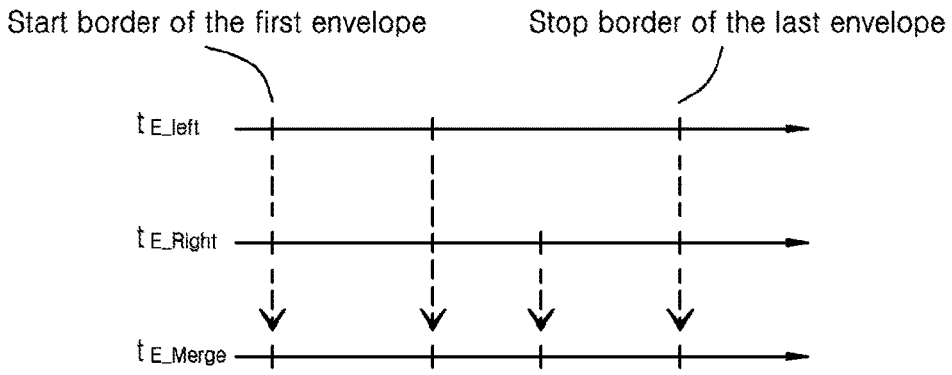
FIG. 10A illustrates an embodiment of determining a time envelope grid when start borders of a first envelope are the same and stop borders of a last envelope are the same.

FIG. 10A illustrates a time envelope grid when start borders of a first envelope are the same and stop borders of a last envelope are the same.

Figure 10B:
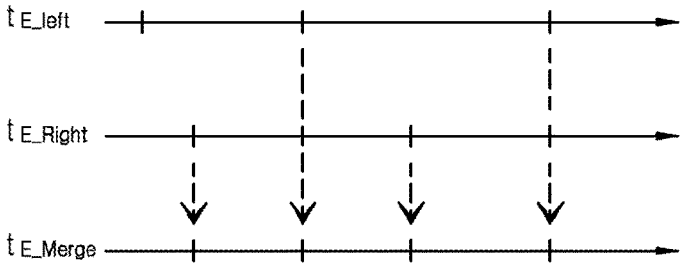
FIG. 10B illustrates an embodiment of determining a time envelope grid when start borders of a first envelope are different and stop borders of a last envelope are the same.

FIG. 10B illustrates a time envelope grid when start borders of a first envelope are different and stop borders of a last envelope are the same.

Figure 10C:
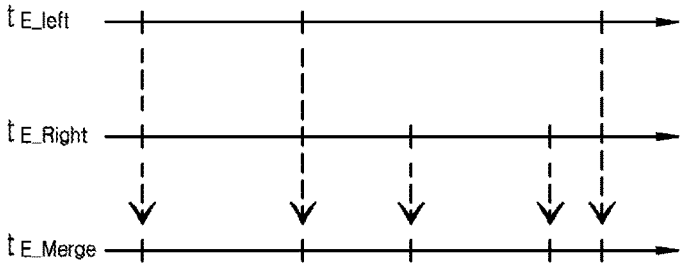
FIG. 10C illustrates an embodiment of determining a time envelope grid when start borders of a first envelope are the same and stop borders of a last envelope are different.

FIG. 10C illustrates a time envelope grid when start borders of a first envelope are the same and stop borders of a last envelope are different.

Figure 10D:
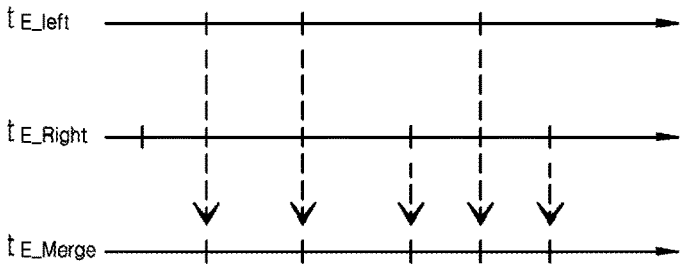
FIG. 10D illustrates an embodiment of determining a time envelope grid when start borders of a first envelope are different and stop borders of a last envelope are different.

FIG. 10D illustrates a time envelope grid when start borders of a first envelope are different and stop borders of a last envelope are different.

A time envelope grid $t_{E_Merged}$ for IC SBR is generated by splitting a stereo SBR time grid into smallest pieces having a highest resolution.

A start border value of $t_{E_Merged}$ is set as a largest start border value for a stereo channel. An envelope between a time grid 0 and a start border has been already processed in a previous frame. Stop borders having largest values among the stop borders of the last envelopes of two channels are selected as the stop borders of the last envelopes.

As shown in FIGS. 10A-10D, by obtaining an intersection between the time borders of the two channels, the start/stop borders of the first and last envelopes are determined to have a most-segmented resolution. If there are at least 5 envelopes, points from a stop point of $t_{E_Merged}$ to a start point of $t_{E_Merged}$ are inversely searched for to find less than 4 envelopes, thereby removing start borders of the less than 4 envelopes in order to reduce the number of envelopes. This process is continued until 5 envelopes are left.

(4) noise time borders

The number of downmixed noise time borders $L_{Q_Merged}$ is determined by taking a noise time border having a large value among noise time borders of two channels. A first grid and a merged noise time border $t_{Q_Merged}$ are determined by taking a first grid and a last grid of the envelope time border $t_{E_Merged}$.

If a downmixed noise time border $L_{Q_Merged}$ is greater than 1, $t_{Q_Merged}(1)$ is selected as $t_Q(1)$ of a channel in which a noise time border $L_Q$ is greater than 1. If both the two channels have noise time borders $L_q$ that are greater than 1, a minimum value of $t_q(l)$ is selected as $t_{Q_Merged}(1)$.

(5) envelope data

FIG. 11 illustrates a method of merging a frequency resolution, which is an SBR parameter, according to an embodiment of the present invention.

A frequency resolution $\tau_{Merged}$ of a merged envelope time border is selected. A maximum value between frequency resolutions $\tau_{ch1}$ and $\tau_{ch2}$ for each section of the frequency resolution $\tau_{Merged}$ is selected as $\tau_{Merged}$ as in FIG. 11.

Envelope data $E_{Orig_Merged}$ for all envelopes is calculated from envelope data $E_{Orig}$ by taking into account format conversion parameters, using Equation 6:

$$\begin{aligned} &E_{Orig_Merged}(k, l) \\ &= E_{ch1Orig}(g_{ch1}(k), h_{ch1}(l)) \times (EQ_{ch1}(k, h_{ch1}(l)))^2 \\ &+ E_{ch2Orig}(g_{ch2}(k), h_{ch2}(l)) \times (EQ_{ch2}(k, h_{ch2}(l)))^2 \end{aligned}$$

where, $$EQ_{ch1}(k, 1) = \frac{\sum_m (G_{ch1}^m \times G_{Q,ch1}^m)}{F(k+1, r_{Merged}(l)) - F(k, r_{Merged}(l))}$$

where $F(k, r_{Merged}(l)) \le m < F(k+1, r_{Merged}(l))$ $$EQ_{ch2}(k, 1) = \frac{\sum_m (G_{ch2}^m \times G_{Q,ch2}^m)}{F(k+1, r_{Merged}(l)) - F(k, r_{Merged}(l))}$$

where $0 \le k < n(r_{Merged}(l))$, $0 \le l < L_{E_Merged}$, $h_{ch1}(l)$ is defined as $t_{E_ch1}(h_{ch1}(l)) \le T_{E_Merged}(l) \le t_{E_ch1}(h_{ch1}(l)+1)$, $h_{ch2}(l)$ is defined as $t_{E_ch2}(h_{ch2}(l)) \le T_{E_Merged}(l) < t_{E_ch2}(h_{ch2}(l)+1)$, $g_{ch1}(k)$ is defined as $F(g_{ch1}(k), r_{ch1}(h_{ch1}(l))) \le F(l, r_{Merged}(l)) < (g_{ch1}(k)+1, r_{ch1}(h_{ch1}(l)))$, and $g_{ch2}(k)$ is defined as $F(g_{ch2}(k), r_{ch2}(h_{ch2}(l))) \le F(k, r_{Merged}(1)) < F(g_{ch2}(k)+1, r_{ch2}(h_{ch2}(l)))$.

(6) noise floor data

Merged noise floor data is determined as a sum of two channel data, according to Equation 7:

$$Q_{OrigMerged}(k, l)=Q_{Origch1}(k, h_{ch1}(l))+Q_{Origch2}(k, h_{ch2}(l))$$

$$0 \le k < N_Q,\ 0 \le 1 < L_{Q_{Merged}}$$

where $h_{ch1}(l)$ is defined as $t_{Q_ch1}(h_{ch1}(l)) \le t_{Q_Merged}(l) < t_{Q_ch1}(h_{ch1}(1)+1)$, and $h_{ch2}(l)$ is defined as $t_{Q_ch2}(h_{ch2}(l)) \le t_{Q_Merged}(1) < t_{Q_ch2}(h_{ch2}(1)+1)$.

The above-described embodiments of the present invention may be embodied as program commands executable by various computer configuration elements and may be recorded on a computer-readable recording medium. The computer-readable recording medium may include program commands, data files, data structures, and the like separately or in combinations. The program commands to be recorded on the computer-readable recording medium may be specially designed and configured for embodiments of the present invention or may be well-known to and be usable by one of ordinary skill in the art of computer software. Examples of the computer-readable recording medium include a magnetic medium (e.g., a hard disk, a floppy disk, or a magnetic tape), an optical medium (e.g., a compact disk-read-only memory (CD-ROM) or a digital versatile disk (DVD), a magneto-optical medium (e.g., a floptical disk), and a hardware device specially configured to store and execute program commands (e.g., a ROM, a random-access memory (RAM), or a flash memory). Examples of the computer program include advanced language codes that can be executed by a computer by using an interpreter or the like as well as machine language codes made by a compiler. The hardware device can be configured to function as one or more software modules so as to perform operations for the present invention, or vice versa.

While the present invention has been particularly shown and described with reference to exemplary embodiments thereof, it will be understood that various changes in form and details may be made therein without departing from the spirit and scope of the following claims.

Therefore, the scope of the present invention is defined not by the detailed description but by the appended claims, and all differences within the scope will be construed as being included in the present invention.

The invention claimed is:

1. A method of processing an audio signal, the method comprising:

receiving a channel pair element bitstream encoded via MPEG Surround 212 (MPS212) and applied spectral band replication (SBR);

generating a band-limited internal channel (IC) signal based on the channel pair element bitstream and an internal channel gain (ICG);

downrnixing a pair of SBR parameters into a mono SBR parameter based on a rendering parameter of a format converter;

generating a full band IC signal based on the generated band-limited IC signal and the mono SBR parameter; and generating stereo output signals, based on the generated full band IC signal.

2. The method of claim 1, wherein the generating of the band-limited IC signal comprises determining whether the IC processing for the channel pair element bitstream is possible.

3. The method of claim 2, wherein whether the IC processing for the channel pair element bitstream is possible is determined based on whether a pair of channels included in the channel pair element bitstream belong to a same IC group.

4. The method of claim 1, wherein when both of a pair of channels included in the channel pair element bitstream are included in a left IC group, the full band IC signal is output via only a left output channel among stereo output channels, and when both of a pair of channels included in the channel pair element bitstream are included in a right IC group, the full band IC signal is output via only a right output channel among the stereo output channels.

5. The method of claim 1, wherein, when both of a pair of channels included in the channel pair element bitstream are included in a center IC group or both of a pair of channels included in the channel pair element bitstream are included in a low frequency effect (LFE) IC group, the full band IC signal is evenly output via a left output channel and a right output channel among stereo output channels.

6. The method of claim 1, wherein the generating of the band-limited IC signal comprises:

calculating the ICG; and applying the ICG.

7. An apparatus for processing an audio signal, the apparatus comprising:

a receiver configured to receive a channel pair element bitstream encoded via MPEG Surround 212 (MPS212) and applied spectral band replication (SBR);

an internal channel (IC) signal generator configured to generate a band-limited IC signal based on the channel pair element bitstream and an internal channel gain (ICG), downmix a pair of SBR parameters into a mono SBR parameter based on a rendering parameter of a format converter, and generate a full band IC signal based on the generated band-limited IC signal and the mono SBR parameter; and a stereo output signal generator configured to generate stereo output signals, based on the generated full band IC signal.

8. The apparatus of claim 7, wherein the IC signal generator is further configured to determine whether the IC processing for the channel pair element bitstream is possible.

9. The apparatus of claim 8, wherein whether the IC processing for the channel pair element bitstream is possible is determined based on whether a pair of channels included in the channel pair element bitstream belong to a same IC group.

10. The apparatus of claim 7, wherein when both of a pair of channels included in the channel pair element bitstream are included in a left IC group, the full band IC signal is output via only a left output channel among stereo output channels, and when both of a pair of channels included in the channel pair element bitstream are included in a right IC group, the full band IC signal is output via only a right output channel among the stereo output channels.

11. The apparatus of claim 7, wherein, when both of the pair of channels included in the channel pair element bitstream are included in a center IC group or both of the pair of channels included in the channel pair element bitstream are included in a low frequency effect (LFE) IC group, the full band IC signal is evenly output via a left output channel and a right output channel among stereo output channels.

12. The apparatus of claim 7, wherein the IC signal generator is configured to calculate the ICG and apply the ICG.

13. A non-transitory computer-readable recording medium having recorded thereon a computer program for executing the method of claim 1.

14. The method of claim 1, wherein the mono SBR parameter $E_{Orig_Merged}$ is determined according to an equation $$E_{Orig_{Merged}}(k, l)=E_{ch1Orig}(g_{ch1}(k), h_{ch1}(l))\times(EQ_{ch1}(k, h_{ch1}(l)))^2+E_{ch2Orig}(g_{ch2}(k), h_{ch2}(l))\times(EQ_{ch2}(k, h_{ch2}(l))^2$$

wherein $$EQ_{ch1}(k, 1) = \frac{\sum_m (G_{ch1}^m \times G_{EQ,ch1}^m)}{F(k+1, r_{Merged}(l)) - F(k, r_{Merged}(l))},$$

$$F(k, r_{Merged}(l)) \le m < F(k+1, r_{Merged}(l)),$$

$$EQ_{ch2}(k, 1) = \frac{\sum_m (G_{ch2}^m \times G_{EQ,ch2}^m)}{F(k+1, r_{Merged}(l)) - F(k, r_{Merged}(l))},$$

$$F(k, r_{Merged}(l)) \le m < F(k+1, r_{Merged}(l)),$$

$0 \le k < n(\tau_{Merged}(l))$, $0 \le 1 < L_{E_Merged}$, $h_{ch1}(l)$ is defined by $t_{E_ch1}(h_{ch1}(l)) \le t_{E_Merged}(l) < t_{E_ch1}(h_{ch1}(l)+1)$, $h_{ch2}(l)$ is defined by $t_{E_ch2}(h_{ch2}(l)) \le t_{E_Merged}(l) < t_{E_ch2}(h_{ch2}(l)+1)$, $g_{ch1}(k)$ is defined by $F(g_{ch1}(k), r_{ch1}(h_{ch1}(l))) \le F(k, r_{Merged}(l)) < F(g_{ch1}(k)+1, r_{ch1}(h_{ch1}(l)))$, and $g_{ch2}(k)$ is defined by $F(g_{ch2}(k), r_{ch2}(h_{ch2}(l))) \le F(k, r_{Merged}(l)) < F(g_{ch2}(k)+1, r_{ch2}(h_{ch2}(l)))$.

15. The apparatus of claim 7, wherein the IC signal generator is further configured to determine the mono SBR parameter $E_{Orig_Merged}$ according to an equation $$E_{Orig_{Merged}}(k, l)=E_{ch1Orig}(g_{ch1}(k), h_{ch1}(l))\times(EQ_{ch1}(k, h_{ch1}(l)))^2+E_{ch2Orig}(g_{ch2}(k), h_{ch2}(l))\times(EQ_{ch2}(k, h_{ch2}(l))^2$$

wherein $$EQ_{ch1}(k, 1) = \frac{\sum_m (G_{ch1}^m \times G_{EQ,ch1}^m)}{F(k+1, r_{Merged}(l)) - F(k, r_{Merged}(l))},$$

$$F(k, r_{Merged}(l)) \le m < F(k+1, r_{Merged}(l)),$$

$$EQ_{ch2}(k, 1) = \frac{\sum_m (G_{ch2}^m \times G_{EQ,ch2}^m)}{F(k+1, r_{Merged}(l)) - F(k, r_{Merged}(l))},$$

$$F(k, r_{Merged}(l)) \le m < F(k+1, r_{Merged}(l)),$$

$0 \le k < n(\tau_{Merged}(l))$, $0 \le 1 < L_{E_Merged}$.

* * * * *